US012791224B1

(12) United States Patent
Farrell et al.

(10) Patent No.: US 12,791,224 B1
(45) Date of Patent: Nov. 10, 2026

(54) SYSTEM AND METHOD FOR ELECTRIC STORAGE WATER HEATER EFFICIENCY REMOTE QUANTIFICATION WITH THE AID OF A DIGITAL COMPUTER

(71) Applicant: Clean Power Research, L.L.C., Napa, CA (US)

(72) Inventors: Brittany Lancaster Farrell, Bellevue, WA (US); Thomas E. Hoff, Napa, CA (US)

(73) Assignee: CLEAN POWER RESEARCH, L.L.C., Napa, CA (US)

( * ) Notice: Subject to any disclaimer, the term of this patent is extended or adjusted under 35 U.S.C. 154(b) by 336 days.

(21) Appl. No.: 18/599,727

(22) Filed: Mar. 8, 2024

(51) Int. Cl.

| | |
|---|---|
| ***F24H 15/152*** | (2022.01) |
| ***F24H 15/164*** | (2022.01) |
| ***F24H 15/168*** | (2022.01) |
| ***F24H 15/254*** | (2022.01) |
| ***F24H 15/273*** | (2022.01) |
| *F24H 15/269* | (2022.01) |

(52) U.S. Cl.
CPC ..... *F24H 15/152* (2022.01); *F24H 15/164* (2022.01); *F24H 15/168* (2022.01); *F24H 15/254* (2022.01); *F24H 15/273* (2022.01); *F24H 15/269* (2022.01)

(58) Field of Classification Search
None
See application file for complete search history.

(56) References Cited

U.S. PATENT DOCUMENTS

| | | | |
|---|---|---|---|
| 3,354,943 | A | 11/1967 | McFarlan |
| 3,923,038 | A | 12/1975 | Cutchaw |
| 4,089,143 | A | 5/1978 | La Pietra |
| 4,992,942 | A | 2/1991 | Bauerle et al. |
| 5,001,650 | A | 3/1991 | Francis et al. |
| 5,177,972 | A | 1/1993 | Sillato et al. |
| 5,602,760 | A | 2/1997 | Chacon et al. |
| 5,803,804 | A | 9/1998 | Meier et al. |
| 6,134,511 | A | 10/2000 | Subbarao |

(Continued)

FOREIGN PATENT DOCUMENTS

| | | |
|---|---|---|
| AU | 2011298219 | 3/2012 |
| CN | 102155358 | 8/2011 |

(Continued)

OTHER PUBLICATIONS

Thomas Huld, "Estimating Solar Radiation and Photovoltaic System Performance," The PVGIS Approach, 2011 (printed Dec. 13, 2017).

(Continued)

*Primary Examiner* — Carlos R Ortiz Rodriguez
(74) *Attorney, Agent, or Firm* — Leonid Kisselev

(57) ABSTRACT

Analysis of the standby losses of a water heater can give important insights into the type and overall efficiency of the water heater independent of the total amount of hot water used by the household. This analysis can be used as part of an energy audit to determine both the presence of the water heater, the efficiency of the water heater, and if adjusting the water heater's settings or replacing the water heater with a more efficient model can conserve energy (and thus be both environmentally and economically advantageous). The analysis is done remotely, allowing to quantify the water heater's efficiency without an intrusive physical audit.

18 Claims, 16 Drawing Sheets

(56) References Cited

U.S. PATENT DOCUMENTS 6,148,623 A 11/2000 Park et al.
6,366,889 B1 4/2002 Zaloom
6,748,327 B1 6/2004 Watson
6,968,295 B1 11/2005 Carr
7,451,017 B2 11/2008 McNally
7,742,892 B2 6/2010 Fromme et al.
7,742,897 B2 6/2010 Herzig
7,920,997 B2 4/2011 Domijan et al.
8,140,193 B2 3/2012 Lee
8,155,900 B1 4/2012 Adams
8,369,994 B1 2/2013 Rosen
8,370,283 B2 2/2013 Pitcher et al.
9,007,460 B2 4/2015 Schmidt et al.
9,020,650 B2 4/2015 Lutze
9,086,585 B2 7/2015 Hamada et al.
9,098,876 B2 8/2015 Steven et al.
9,103,719 B1 8/2015 Ho et al.
9,171,276 B2 10/2015 Steven et al.
9,286,464 B2 3/2016 Choi
9,524,529 B2 12/2016 Sons et al.
9,599,597 B1 3/2017 Steele et al.
10,103,548 B2 10/2018 He et al.
10,302,312 B2 * 5/2019 Thornton ..... F24D 19/1069
10,409,241 B2 9/2019 Wartena et al.
10,935,992 B1 3/2021 Morse et al.
2002/0055358 A1 5/2002 Hebert
2003/0201749 A1 10/2003 Hossain et al.
2005/0055137 A1 3/2005 Andren et al.
2005/0095978 A1 5/2005 Blunn et al.
2005/0222715 A1 10/2005 Ruhnke et al.
2007/0084502 A1 4/2007 Kelly et al.
2007/0119175 A1 * 5/2007 Ruggieri ..... F01K 25/06 60/649
2007/0119718 A1 5/2007 Gibson et al.
2007/0233534 A1 10/2007 Martin et al.
2008/0258051 A1 10/2008 Heredia et al.
2009/0037241 A1 2/2009 Olsen et al.
2009/0106079 A1 4/2009 Gutlapalli et al.
2009/0125275 A1 5/2009 Woro
2009/0154384 A1 6/2009 Todd et al.
2009/0217965 A1 9/2009 Dougal et al.
2009/0271154 A1 10/2009 Coad et al.
2009/0302681 A1 12/2009 Yamada et al.
2010/0070084 A1 3/2010 Steinberg et al.
2010/0161502 A1 6/2010 Kumazawa et al.
2010/0188413 A1 7/2010 Hao et al.
2010/0198420 A1 8/2010 Rettger et al.
2010/0211222 A1 8/2010 Ghosn
2010/0219983 A1 9/2010 Peleg et al.
2010/0263709 A1 10/2010 Norman et al.
2010/0309330 A1 12/2010 Beck
2010/0324962 A1 12/2010 Nesler et al.
2010/0332373 A1 12/2010 Crabtree et al.
2011/0066401 A1 3/2011 Yang et al.
2011/0137591 A1 6/2011 Ishibashi
2011/0137763 A1 6/2011 Aguilar
2011/0145037 A1 6/2011 Domashchenko et al.
2011/0272117 A1 11/2011 Hamstra et al.
2011/0276269 A1 11/2011 Hummel
2011/0282504 A1 11/2011 Besore et al.
2011/0307109 A1 12/2011 Sri-Jayantha
2012/0065783 A1 3/2012 Fadell et al.
2012/0066168 A1 3/2012 Fadell et al.
2012/0078685 A1 3/2012 Krebs et al.
2012/0084063 A1 4/2012 Drees et al.
2012/0095798 A1 4/2012 Mabari
2012/0130556 A1 5/2012 Marhoefer
2012/0143383 A1 6/2012 Cooperrider et al.
2012/0143536 A1 6/2012 Greaves et al.
2012/0158350 A1 6/2012 Steinberg et al.
2012/0191439 A1 7/2012 Meagher et al.
2012/0232701 A1 9/2012 Carty et al.
2012/0271576 A1 10/2012 Kamel et al.
2012/0278051 A1 11/2012 Jiang et al.
2012/0310416 A1 12/2012 Tepper et al.
2012/0310427 A1 12/2012 Williams et al.
2012/0310729 A1 12/2012 Dalto et al.
2012/0330626 A1 12/2012 An et al.
2013/0008224 A1 1/2013 Stormbom
2013/0030590 A1 1/2013 Prosser
2013/0054662 A1 2/2013 Coimbra
2013/0060471 A1 3/2013 Aschheim et al.
2013/0134962 A1 5/2013 Kamel et al.
2013/0144546 A1 6/2013 Brackney et al.
2013/0152998 A1 6/2013 Herzig
2013/0166266 A1 6/2013 Herzig et al.
2013/0190940 A1 7/2013 Sloop et al.
2013/0204439 A1 8/2013 Scelzi
2013/0245847 A1 9/2013 Steven et al.
2013/0262049 A1 10/2013 Zhang et al.
2013/0268129 A1 10/2013 Fadell et al.
2013/0274937 A1 10/2013 Ahn et al.
2013/0289774 A1 10/2013 Day et al.
2013/0304269 A1 11/2013 Shiel
2013/0314699 A1 11/2013 Jungerman et al.
2013/0325377 A1 12/2013 Drees et al.
2014/0039648 A1 2/2014 Boult et al.
2014/0039709 A1 2/2014 Steven et al.
2014/0039965 A1 2/2014 Steven et al.
2014/0107851 A1 4/2014 Yoon et al.
2014/0129197 A1 5/2014 Sons et al.
2014/0142862 A1 5/2014 Umeno et al.
2014/0214222 A1 7/2014 Rouse et al.
2014/0222241 A1 8/2014 Ols
2014/0236708 A1 8/2014 Wolff et al.
2014/0278108 A1 9/2014 Kerrigan et al.
2014/0278145 A1 9/2014 Angeli et al.
2014/0278165 A1 9/2014 Wenzel et al.
2014/0278203 A1 9/2014 Lange et al.
2014/0289000 A1 9/2014 Hutchings et al.
2014/0297238 A1 10/2014 Parthasarathy et al.
2014/0365017 A1 12/2014 Hanna et al.
2015/0019034 A1 1/2015 Gonatas
2015/0057820 A1 2/2015 Kefayati et al.
2015/0088576 A1 3/2015 Steven et al.
2015/0094968 A1 4/2015 Jia et al.
2015/0112497 A1 4/2015 Steven et al.
2015/0134251 A1 5/2015 Bixel
2015/0177415 A1 6/2015 Bing
2015/0188415 A1 7/2015 Abido et al.
2015/0269664 A1 9/2015 Davidson
2015/0276495 A1 10/2015 Smullin et al.
2015/0278968 A1 10/2015 Steven et al.
2015/0323423 A1 11/2015 Alsaleem
2015/0326015 A1 11/2015 Steven et al.
2015/0330923 A1 11/2015 Smullin
2015/0332294 A1 11/2015 Albert et al.
2015/0339762 A1 11/2015 Deal et al.
2015/0355017 A1 12/2015 Clarke et al.
2016/0049606 A1 2/2016 Bartoli et al.
2016/0072287 A1 3/2016 Jia et al.
2016/0140283 A1 5/2016 Morse et al.
2016/0187911 A1 6/2016 Carty et al.
2016/0223503 A1 8/2016 Abehassera et al.
2016/0226253 A1 8/2016 Abido et al.
2016/0266594 A1 9/2016 Kauffman et al.
2016/0305678 A1 10/2016 Pavlovski et al.
2016/0306906 A1 10/2016 McBrearty et al.
2016/0348936 A1 12/2016 Johnson et al.
2016/0379175 A1 12/2016 Bhattacharya et al.
2017/0104451 A1 4/2017 Gostein
2017/0299446 A1 10/2017 Lange et al.
2018/0010818 A1 1/2018 Maruyama et al.
2018/0047170 A1 2/2018 Hamann et al.
2018/0087795 A1 3/2018 Okita et al.
2020/0117839 A1 4/2020 Tamasato
2021/0350041 A1 11/2021 Lepley
2022/0058556 A1 2/2022 Warake et al.
2022/0100802 A1 3/2022 Saini et al.

FOREIGN PATENT DOCUMENTS

CN 107579706 12/2018
JP 4799838 10/2011

(56) References Cited

FOREIGN PATENT DOCUMENTS

| | | |
|---|---|---|
| WO | 2007124059 | 11/2007 |
| WO | 2007142693 | 12/2007 |
| WO | 2013181408 | 12/2013 |
| WO | 2014081967 | 5/2014 |
| WO | 2016164718 | 10/2016 |

OTHER PUBLICATIONS

Anderson et al., "Modelling The Heat Dynamics Of A Building Using Stochastic Differential Equations," Energy and Building, vol. 31, 2000, pp. 13-24.
Brinkman et al., "Toward a Solar-Powered Grid." IEEE Power & Energy, vol. 9, No. 3, May/Jun. 2011.
California ISO. Summary of Preliminary Results of 33% Renewable Integration Study—2010 CPUC LTPP. Docket No. R. 10-05-006, May 10, 2011.
Ellis et al., "Model Makers." IEEE Power & Energy, vol. 9, No. 3, May/Jun. 2011.
Danny H.W. Li et al., "Analysis of solar heat gain factors using sky clearness index and energy implications." Energy Conversions and Management, Aug. 2000.
Hoff et al., "Quantifying PV Power Output Variability." Solar Energy 84 (2010) 1782-1793, Oct. 2010.
Hoff et al., "PV Power Output Variability: Calculation of Correlation Coefficients Using Satellite Insolation Data." American Solar Energy Society Annual Conference Proceedings, Raleigh, NC, May 18, 2011.
Kuszamaul et al., "Lanai High-Density Irradiance Sensor Network for Characterizing Solar Resource Variability of MW-Scale PV System." 35th Photovoltaic Specialists Conference, Honolulu, HI. Jun. 20-25, 2010.
Serban C. "Estimating Clear Sky Solar Global Radiation Using Clearness Index, for Brasov Urban Area". Proceedings of the 3rd International Conference on Maritime and Naval Science and Engineering. ISSN: 1792-4707, ISBN: 978-960-474-222-6.
Mills et al., "Dark Shadows." IEEE Power & Energy, vol. 9, No. 3, May/Jun. 2011.
Mills et al., "Implications of Wide-Area Geographic Diversity for Sort-Term Variability of Solar Power." Lawrence Berkeley National Laboratory Technical Report LBNL-3884E. Sep. 2010.
Perez et al., "Parameterization of site-specific short-term irradiance variability." Solar Energy, 85 (2011) 1343-1345, Nov. 2010.
Perez et al., "Short-term irradiance variability correlation as a function of distance." Solar Energy, Mar. 2011.
Philip, J., "The Probability Distribution of the Distance Between Two Random Points in a Box." www.math.kth.se/~johanph/habc.pdf. Dec. 2007.
Stein, J., "Simulation of 1-Minute Power Output from Utility-Scale Photovoltaic Generation Systems." American Solar Energy Society Annual Conference Proceedings, Raleigh, NC, May 18, 2011.
Solar Anywhere, 2011. Web-Based Service that Provides Hourly, Satellite-Derived Solar Irradiance Data Forecasted 7 days Ahead and Archival Data back to Jan. 1, 1998. www.SolarAnywhere.com.
Stokes et al., "The atmospheric radiance measurement (ARM) program: programmatic background and design of the cloud and radiation test bed." Bulletin of American Meteorological Society vol. 75, No. 7, pp. 1201-1221, Jul. 1994.
Hoff et al., "Modeling PV Fleet Output Variability," Solar Energy, May 2010.
Olopade et al., "Solar Radiation Characteristics and the performance of Photovoltaic (PV) Modules in a Tropical Station." Journal Sci. Res. Dev. vol. 11, 100-109, 2008/2009.
Li et al., "Analysis of solar heat gain factors using sky clearness index and energy implications." 2000.
Shahab Poshtkouhi et al., "A General Approach for Quantifying the Benefit of Distributed Power Electronics for Fine Grained MPPT in Photovoltaic Applications Using 3-D Modeling," Nov. 20, 12, IEE Transactions on Poweer Electronics, vol. 27, No. 11, p. 4656-4666.
Pathomthat Chiradeja et al., "An Approaching to Quantify the Technical Benefits of Distributed Generation," Dec. 2004, IEEE Transactions oin Energy Conversation, vol. 19, No. 4, p. 764-773.
Mudathir Funsho Akorede et al., "Distributed Energy Resources and Benefits to the Environment," 2010, Renewable and Sustainable Energy Reviews 14, p. 724-734.
V.H. Mendez, et al., "Impact of Distributed Generation on Distribution Investment Deferral," 2006, Electrical Power and Energy Systems 28, p. 244-252.
Francisco M. Gonzalez-Longatt et al., "Impact of Distributed Generation Over Power Losses on Distribution System," Oct. 2007, Electrical Power Quality and Utilization, 9th International Conference.
M. Begovic et al., "Impact of Renewable Distributed Generation on Power Systems," 2001, Proceedings of the 34th Hawaii International Conference on System Sciences, p. 1-10.
M. Thomson et al., "Impact of Widespread Photovoltaics Generation on Distribution Systems," Mar. 2007, IET Renew. Power Gener., vol. 1, No. 1 p. 33-40.
Varun et al., "LCA of Renewable Energy for Electricity Generation Systems—A Review," 2009, Renewable and Sustainable Energy Reviews 13, p. 1067-1073.
Andreas Schroeder, "Modeling Storage and Demand Management in Power Distribution Grids," 2011, Applied Energy 88, p. 4700-4712.
Daniel S. Shugar, "Photovoltaics in the Utility Distribution System: The Evaluation of System and Distributed Benefits," 1990, Pacific Gas and Electric Company Department of Research and Development, p. 836-843.
Nguyen et al., "Estimating Potential Photovoltaic Yield With r.sun and the Open Source Geographical Resources Analysis Support System," Mar. 17, 2010, pp. 831-843.
Pless et al., "Procedure For Measuring And Reporting The Performance of Photovoltaic Systems In Buildings," 62 pages, Oct. 2005.
Emery et al., "Solar Cell Efficiency Measurements," Solar Cells, 17 (1986) 253-274.
Santamouris, "Energy Performance of Residential Buildings," James & James/Earchscan, Sterling, VA 2005.
Al-Homoud, "Computer-Aided Building Energy Analysis Techniques," Building & Environment 36 (2001) pp. 421-433.
Mahyuddin, Norhayati, Hazim B. Awbi, and Mohammed Alshitawi. "The spatial distribution of carbon dioxide in rooms with particular application to classrooms." Indoor and Built Environment 23.3 (2014): 433-448. See the abstract, and pp. 435-445. (Year: 2014).
Montoya, Marfa I., Elsa Pastor, and Eulalia Planas. ""Air infiltration in Catalan dwellings and sealed rooms: An experimental study."" Building and environment 46.10 (2011): 2003-2011. See the abstract and §§ 2 and 4. (Year: 2011).
Mahyuddin, Norhayati, and Hazim Awbi. "The spatial distribution of carbon dioxide in an environmental test chamber." Building and Environment 45.9 (2010): 1993-2001. See the abstract and§§ 2.2, 3, 4.2, and 5 (Year: 2010).
Samer, M., et al. "Heat balance and tracer gas technique for airflow rates measurement and gaseous emissions quantification in naturally ventilated livestock buildings." Energy and buildings 43.12 (2011): 3718-3728. See the abstract and §§ 2.5-2.7 (Year: 2011).
Fan, Yunqing, et al. ""Field-based study on the energy-saving effects of CO2 demand controlled ventilation in an office with application of energy recovery ventilators."" Energy and buildings 68 (2014): 412-422. See the abstract and pp. 413-415 (Year: 2014).
Keig, Peter, Trevor Hyde, and Grainne McGill. "A comparison of the estimated natural ventilation rates of four solid wall houses with the measured ventilation rates and the implications for low-energy retrofits." Indoor and Built Environment 25.1 (2016): 169-179. ( Year: 2016).
Gruber, Mattias, Anders Truschel, and Jan-Olof Dalenback. "CO2 sensors for occupancy estimations: Potential in building automation applications." Energy and Buildings 84 (2014): 548-556. (Year: 2014).
Hanninen, Otto, et al. "Combining CO2 data from ventilation phases improves estimation of air exchange rates." Proceedings of Healthy Buildings Conference, Brisbane. 2012. (Year: 2012).

(56) References Cited

OTHER PUBLICATIONS

Kapalo, Peter, et al. "Determine a methodology for calculating the needed fresh air." Environmental Engineering. Proceedings of the International Conference on Environmental Engineering. ICEE. vol. 9. Vilnius Gediminas Technical University, Department of Construction Economics & Property, 2014. (Year: 2014).
Wang, Shengwei, and Xinqiao Jin. "CO2-based occupancy detection for on-line outdoor air flow control." Indoor and Built Environment 7.3 (1998): 165-181. (Year: 1998).
Grot, Richard A., et al. Measurement methods for evaluation of thermal integrity of building envelopes. No. PB-83-180174; NBSIR—82-2605. National Bureau of Standards, Washington, DC (USA). Center for Building Technology, 1982. (Year: 1982).
Claude-Alain, Roulet, and Flavia Foradini. "Simple and cheap air change rate measurement using CO2 concentration decays." International Journal of Ventilation 1.1 (2002): 39-44. (Year: 2002).
Ng, Lisa Chen, and Jin Wen. "Estimating building airflow using CO2 measurements from a distributed sensor network." HVAC&R Research 17.3 (2011): 344-365. (Year: 2011).
Shuqing Cui et al., "CO2 tracer gas concentration decay method for measuring air change rate," Nov. 18, 2014, Building and Environment, vol. 84, pp. 162-169; (Year: 2014).
Robert C. Sondregger et al., "In-situ measurements of residential energy performance using electric co-heating," 1980, Lawrence Berkeley Laboratory, 26 pages (Year: 1980).
Yu-Pei Ke , "Using carbon dioxide measurements to determine occupancy for ventilation controls," 1997, https://www.aivc.org/sites/ default/files/airbase_10515.pdf, pp. 1-9 (Year: 1997).
T. Leephakpreeda et al., "Occupancy-based control of indoor air ventilation: a theoretical and experimental study," 2001, ScienceAsia, vol. 27, pp. 279-284 (Year: 2001).
Cali, Davide, et al. "CO2 based occupancy detection algorithm: Experimental analysis and validation for office and residential buildings." Building and Environment 86 (2015): 39-49. (Year: 2015).
Judkoff et al., "Side-by-Side Thermal Tests of Modular Offices: A Validation Study of the STEM Method", Dec. 2000, NREUTP-550-23940 (Year: 2000).
Bauwens et al., "State-of-the-art on the co-heating test methodology", Jan. 22, 2014, Webinar: "How to determine the real performances of buildings? Building characterisation by co-heating", URL: dynastee(dot)info/webinar-presentations-how-to-determine-the-real-performances-of-buildings/ (Year: 2014).
Andrews, John W., Richard F. Krajewski, and John J. Strasser. Electric co-heating in the ASHRAE standard method oftest for thermal distribution efficiency: Test results on two New York State homes. No. BNL-62346; CONF-960254-1. Brookhaven National Lab.(BN L), Upton, NY (United States), 1995. (Year: 1995).
Balcomb, J. D., et al. "Short-term energy monitoring for commercial buildings." Proceedings of the 1994 ACEEE Summer Study on Energy Efficiency in Buildings. 1994 (Year: 1994).
Bauwens, Geert, and Staf Roels. "Co-heating test: A state-of-the-art." Energy and Buildings 82 (2014): 163-172. (Year: 2014).
Carrillo, Antonio, Fernando Dominguez, and Jose M. Cejudo. "Calibration of an EnergyPlus simulation model by the STEM-PSTAR method." Eleventh International IBPSA Conference, Glasgow, Scotland. 2009. (Year: 2009).
Jack, "Building Diagnostics: Practical Measurement of the Fabric Thermal Performance of Houses", Jul. 2015, PhD Dissertation, Loughborough University, United Kingdom (Year: 2015).
Johnston, David, et al. "Whole house heat loss test method (Coheating)." Leeds Metropolitan University: Leeds, UK (2013). (Year: 2013).
Judkoff, R., et al. Buildings in a Test Tube: Validation of the Short-Term Energy Monitoring (STEM) Method (Preprint). No. Nrel/ CP-550-29805. National Renewable Energy Lab.(NREL), Golden, CO (United States), 2001. (Year: 2001).
NHBC Foundation, "Review of co-heating test Methodologies", Nov. 2013, URL: www(dot)nhbcfoundation(dot)org/wp-content/uploads/2016/05/NF54-Review-of-co-heating-test-methodologies(dot)pdf (Year: 2013).
Siviour, J. "Experimental thermal calibration of houses." Rapid Thermal Calibration of Houses; Everett, R., Ed.; Technical Report ERG 55 (1981). (Year: 1981).
Modera, M. P. "Electric Co-Heating: A Method for Evaluating Seasonal Heating Efficiencies and Heat Loss Rates in Dwellings." ( 1979). (Year: 1979).
Sonderegger, Robert C., Paul E. Condon, and Mark P. Madera. In-situ measurements of residential energy performance using electric co-heating. No. LBL-10117; CONF-800206-4. California Univ., Berkeley (USA). Lawrence Berkeley Lab., 1980. (Year: 1980).
Stoecklein, A., et al. "The household energy end-use project: measurement approach and sample application of the New Zealand household energy model." Conference Paper. No. 87. 2001. (Year: 2001).
Subbarao, K., et al. Short-Term Energy Monitoring (STEM): Application of the PSTAR method to a residence in Fredericksburg, Virginia. No. SERI/TR-254-3356. Solar Energy Research Inst., Golden, CO (USA), 1988. (Year: 1988).
J. Galvao, S. Leitao, S. Malheiro and T. Gaio, "Model of decentralized energy on improving the efficiency in building services," Proceedings of the 2011 3rd International Youth Conference on Energetics (IYCE), Leiria, Portugal, 2011, pp. 1-8. (Year: 2011).
Dong, Bing, and Khee Poh Lam. "A real-time model predictive control for building heating and cooling systems based on the occupancy behavior pattern detection and local weather forecasting." Building Simulation. vol. 7. No. 1. Springer Berlin Heidelberg, 2014. (Year: 2014).
Parsons, Peter. "Determining infiltration rates and predicting building occupancy using CO2 concentration curves." Journal of Energy 2014 (2014). (Year: 2014).
J. Kleissl & Y. Agarwal, "Cyber-Physical Energy Systems: Focus on Smart Buildings," Design Automation Conference, Anaheim, CA, 2010, pp. 749-754, doi: 10.1145/1837274.1837464. (2010).
Fine_1980(Analysis of Heat Transfer in Building Thermal Insulation, Oak Ridge National Laboratory ORNL/TM-7481) (Year: 1980).
Chapter2_1985 (Rates of Change and the Chain Rule, Springer-Verlag) (Year: 1985).
E.S. Mustafina et al. "Problems of Small Heat Power Stations and Ways to Solve Them," Proceedings. The 8th Russian-Korean International Symposium on Science and Technology, 2004. KORUS 2004. Tomsk, Russia, 2004. pp. 267-270. vol. 1, doi:10.1109/KORUS.2004. 1555341. (Year 2004).
Di Yuhui, Di Yulin, Wang Yonghui and Wen Li, "Application and Analysis of Water Source Heat Pump System in Residential Buildings," 2011 International Symposium on Water Resource and Environmental Protection, 2011, pp. 2425-2428, doi: 10.1109/ISWREP.2011.5893758. (Year: 2011).
Clito Afonso, "Tracer gas technichue for measurement of air infiltration and natural ventilation: case studies amd new devices for measurement of mechamocal air ventilation in ducts." 2013, International Journal of Low-Carbon Technologies 2015, Issue 10, pp. 188-204 (Year: 2013).
Isaac Turiel et al., "Occupant-generated CO2 as an indicator of ventilation rate," 1980, Lawrence Berkley Laboratory, 26 pages (Year: 1980).
Andrew K. Persily, "Tracer gas techniques for studying building air exchange," 1988, National Bureau of Standards, 44 pages (Year: 1988).
Detlef Laussmann et al., "Air change measurements using tracer gasses,""2011, In book: Chemistry, Emission Control, Radioactive Pollution and Indoor Air Quality, 42 pages (Year: 2011)".
Cheng, Pok Lun, and Xiaofeng Li. "Air change rate measurements using tracer gas carbon dioxide from dry ice." International Journal of Ventilation 13.3 (2014): 235-246. See the abstract, § 1, § 2.1 and §§ 2.3-2.5 ; and §§ 4.1-4.1.3 (Year: 2014).
Zhang, Yue, Xiaofeng Li, and Pok L. Cheng. "Optimal window opening based on natural ventilation measurements." (2015). 36th AIVC Conference" Effective ventilation in high performance buildings", Madrid, Spain, Sep. 23-24, 2015. See the abstract,§§ 2.1-2.6 (Year: 2015).

(56) References Cited

OTHER PUBLICATIONS

Chamie, G., et al. "Household ventilation and tuberculosis transmission in Kampala, Uganda." The International journal of tuberculosis and lung disease 17.6 (2013): 764-770. See the abstract and the section "Methods" (Year: 2013).
ASTM, "Standard Test Method for Determining Air Change in a Single Zone by Means of a Tracer Gas Dilution", Designation: E 741'—00 (Reapproved 2006)—see§§ 1,4-6, 8, 13-14 (Year: 2006).
Stuart, Ralph, Ellen Sweet, and Aaron Batchelder. "Assessing general ventilation effectiveness in the laboratory." Journal of Chemical Health & Safety 22.2 (2015): 2-7. (Year: 2015).
1997 Ashrae Handbook, "Chapter 28 Nonresidential Cooling and Heating Load Calculation Procedures," 1997, Ashrae, 65 pagges (Year: 1997).
2001 Ashrae Handbook, "Chapter 29 Nonresidential Cooling and Heating Load Calculation Procedures," 2001, Ashrae, 41 pagges (Year: 2001).
Jeffrey D. Spitler, "Load Calculation applications Manual (I-P)", 2014, second edition, chapter "Fundammentals of the Radiant Time Series Method," Ashrae, 31 pages (Year: 2014).
Liu, Xiaochen, et al. "Evaluation of air infiltration in a hub airport terminal: On-site measurement and numerical simulation." Building and Environment 143 (2018): 163-177. See the abstract and§§ 2-3 as well as§§ 5-6. (Year: 2018).
Bou-Saada, Tarek Edmond. An Improved Procedure for Developing a Calibrated Hourly Simulation Model of an Electrically Heated and Cooled Commercial Buildling. Diss. Energy Systems Laboratory, 1994. (Year: 1994).

* cited by examiner

20

60

70

80

90

| Time | | Duration | Measured HPWH Load | | Garage Temp. |
|---|---|---|---|---|---|
| Start | End | | Total | Per Day | |
| 2/5/23 14:00 | 2/7/23 12:00 | 1.96 days | 1.01 kWh | 0.52 kWh | 60° F |
| 3/9/23 14:00 | 3/11/23 12:00 | 1.96 days | 1.06 kWh | 0.54 kWh | 58° F |
| 3/11/23 13:00 | 3/13/23 12:00 | 2.00 days | 0.99 kWh | 0.49 kWh | 58° F |
| 3/13/23 13:00 | 3/15/23 12:00 | 2.00 days | 0.96 kWh | 0.48 kWh | 59° F |
| 3/29/23 14:00 | 3/31/23 13:00 | 2.00 days | 1.08 kWh | 0.54 kWh | 59° F |
| 3/31/23 14:00 | 4/2/23 12:00 | 1.96 days | 0.92 kWh | 0.47 kWh | 61° F |
| 7/13/23 15:00 | 7/15/23 12:00 | 1.92 days | 0.72 kWh | 0.38 kWh | 74° F |
| 8/7/23 13:00 | 8/9/23 12:00 | 2.00 days | 0.69 kWh | 0.35 kWh | 76° F |
| 8/9/23 13:00 | 8/11/23 12:00 | 2.00 days | 0.62 kWh | 0.31 kWh | 75° F |
| 10/5/23 13:00 | 10/7/23 12:00 | 2.00 days | 0.61 kWh | 0.31 kWh | 77° F |

Fig. 22.

221

| Home | Location (City, State) | Location (within home) | Water Heater Type | Water Heater Size (gal) | Uniform Energy Factor | Standby Energy Average kWh/day | Average State Electric Rate (¢/kWh, EIA 2023) | Standby Cost ($/year) |
|---|---|---|---|---|---|---|---|---|
| 1 | Napa, CA | Garage | Heat Pump | 80 | 3.5 | 0.44 | 29.99 | $ 48.16 |
| 2 | Boise, ID | Main House | Electric Resistance | 50 | 0.9 | 0.90 | 11.60 | $ 38.11 |
| 3 | Bellevue, WA | Exterior closet | Electric Resistance | 45 | 0.93 | 1.08 | 11.38 | $ 44.86 |
| 4 | Spokane, WA | Basement | Electric Resistance | 50 | 0.92 | 1.66 | 11.38 | $ 68.95 |

230

SYSTEM AND METHOD FOR ELECTRIC STORAGE WATER HEATER EFFICIENCY REMOTE QUANTIFICATION WITH THE AID OF A DIGITAL COMPUTER

FIELD

The present invention relates in general to energy conservation, and, in particular, to a system and method for electric storage water heater efficiency remote quantification with the aid of a digital computer.

BACKGROUND

There is a growing concern about the potential consequences of global warming due to carbon emissions. A major source of carbon emissions comes from the burning of fossil fuels to provide energy. As a result, there is an increasing focus on both converting the energy supply to clean energy sources that do not produce carbon emissions as well as on reducing energy consumption at the point of end-use.

Water heating is a major end-use energy consumer within the residential sector. Table 1 presents the annual household site end-use consumption in the United States from the Energy Information Agency's 2020 Residential Energy Consumption Survey (www.eia.gov/consumption/residential/data/2020/c&e/xls/ce3.1.xlsx). Table 1 shows that water heating is the second highest identified end-use consumption for households, corresponding to nearly 20 percent of the total energy consumed. The percentage can be even higher in locations that have lower space heating loads. A further examination of the EIA's data shows that consumption is substantial no matter how one slices the data, with the results being similar across: census regions; urban or rural designations; housing unit type; ownership; year of construction; and main heating fuel.

TABLE 1

| Total | Space heating | Water heating | Air conditioning | Refrigerators | Other |
|---|---|---|---|---|---|
| 76.8 MMBtu | 34.4 MMBtu | 14.1 MMBtu | 7.9 MMBtu | 2.9 MMBtu | 20.2 MMBtu |

While water heating currently consumes a lot of energy, this situation does not need to remain the same in the future. Take, as an example, a sample home in Napa, CA. In 2014, this home was converted from a standard natural gas water heater to an electric heat pump water heater (HPWH). Prior to upgrading the water heater, the home in Napa consumed 14.7 MMBtu of natural gas annually for water heating, with this consumption being close to the national average. The house installed a well-insulated, high-quality, electric heat pump water heater in a well-insulated garage, and as a result, energy consumption was greatly reduced. In the past year (2023), the house consumed 1.4 MMBtu (423 kWh) of electricity for water heating, thus reducing energy consumption for water heating by 90 percent.

While such a large decrease in in energy consumption is impressive, the same result may not be achieved using all type of water heaters in all types of environments. Further, even if a water heater is highly efficient at the beginning of the water heater's service life, the water heater's efficiency can degrade over time due to mechanical degradation of heater components, leaving the owner of the water heater under a false impression with regards to the heater's efficiency. In addition, the water heater's settings used by the owner may not allow the water heater to operate as efficiently as the water heater's design allows, further deceiving the owner with regard's to the water heater's actual efficiency.

Despite the importance of knowing the efficiency of the water heater, neither water heater's owners nor utility companies currently have a readily available way to check the water heater's efficiency. In particular, while a physical examination of the water heater may reveal clues to the level of degradation the water heater has experienced, such examination requires a physical presence of a technician at the premises where the water heater is located, thus being slow, expensive, and intrusive. Further, such physical examination may not provide information regarding other factors that can affect the water heater's efficiency. In addition, for a party that is not privy to details of heating of a particular building, the very presence of an electric storage water heater may not be known.

Accordingly, there is a need for a way to comprehensively analyze efficiency of an electric storage water heater without requiring an intrusive physical audit.

SUMMARY

Analysis of the standby losses of a water heater can give important insights into the type and overall efficiency of the water heater independent of the total amount of hot water used by the household. This analysis can be used as part of an energy audit to determine both the presence of the water heater, the efficiency of the water heater, and if adjusting the water heater's settings or replacing the water heater with a more efficient model can conserve energy (and thus be both environmentally and economically advantageous). The analysis is done remotely, allowing to quantify the water heater's efficiency without an intrusive physical audit.

In one embodiment, a system and method for electric storage water heater efficiency remote quantification with an aid of a digital computer is provided. Data regarding an electrical load associated with a building during a time period is obtained by a computer. Days during the time period during which the building was unoccupied are identified by the computer A determination of whether the electric load for the building comprises a load associated with an electric storage water heater associated with the building is obtained by the computer using the identified unoccupied days. Upon determining that the electric load includes the electric storage water heater load, thermal heat losses during the time period that are associated with the electric storage water heater load are estimated by the computer, including: identifying one or more continuous periods of the unoccupied days during the time period; determining daily thermal losses associated with the electric storage water heater during portions of at least some of the continuous periods; obtaining an average ambient temperature associated with a location of the electric water storage during the portions; performing linear regression on the daily thermal losses versus the average ambient temperature; obtaining by the computer an average ambient temperature during the time period that is associated with the electric storage water heater; and calculating the thermal losses associated with the electric storage water heater during the time period using a result of the linear regression and the average ambient temperature during the time period.

Still other embodiments of the present invention will become readily apparent to those skilled in the art from the following detailed description, wherein is described embodiments of the invention by way of illustrating the best mode contemplated for carrying out the invention. As will be realized, the invention is capable of other and different embodiments and its several details are capable of modifications in various obvious respects, all without departing from the spirit and the scope of the present invention. Accordingly, the drawings and detailed description are to be regarded as illustrative in nature and not as restrictive.

BRIEF DESCRIPTION OF THE DRAWINGS

FIG. 22 is table showing calculated average daily thermal losses (standby energy) and standby cost for the four individual water heaters of the four houses under study, including basic home and water heater information, as well as the results of the audit for each home.

DETAILED DESCRIPTION

The amount of energy required for water heating is based on several factors. The factors can be grouped into categories of technology, tank insulation quality, and temperature.

Technology factors include fuel type and conversion technologies used in the storage water heater (also referred to as a "water heater" or "heater" below). Fuel types include natural gas, electricity, fuel oil, kerosene, propane, and wood and conversion technologies include combustion, electric resistance, and electric heat pumps. Of these technologies, electric HPWH is far more efficient than other types of water heaters because they use energy to move existing heat rather than burn fuel to create heat.

Tank insulation quality refers to how well the water storage tank of the water heater is insulated. Some tanks have minimal insulation, such as about an inch of fiberglass insulation around the tank. Other tanks are well insulated, having three inches of high density, polyurethane foam insulation that encloses the entire tank.

Temperature includes both water and ambient air temperature. Occupants can adjust the water temperature setpoint on most water heaters to match their needs and desires, with a typical range of 120° F. and 140° F. Ambient air temperature is a factor of the water heater placement. Water heaters can be located in fully conditioned interior spaces with tightly controlled temperature, semi-conditioned spaces such as garages or basements with slightly higher temperature variance, or unconditioned spaces which closely follow outdoor temperatures.

The water and ambient air temperatures affect the water heater efficiency in multiple ways. First, for water heaters with storage tanks, the differential between water and ambient air temperatures combined with the tank insulation determines standby thermal losses. Additionally, for HPWH, ambient air temperature at the time of water heating determines water heating efficiency. The combination of thermal losses and conversion efficiency determines the overall energy consumption of the water heater.

The Method

Figure 1:
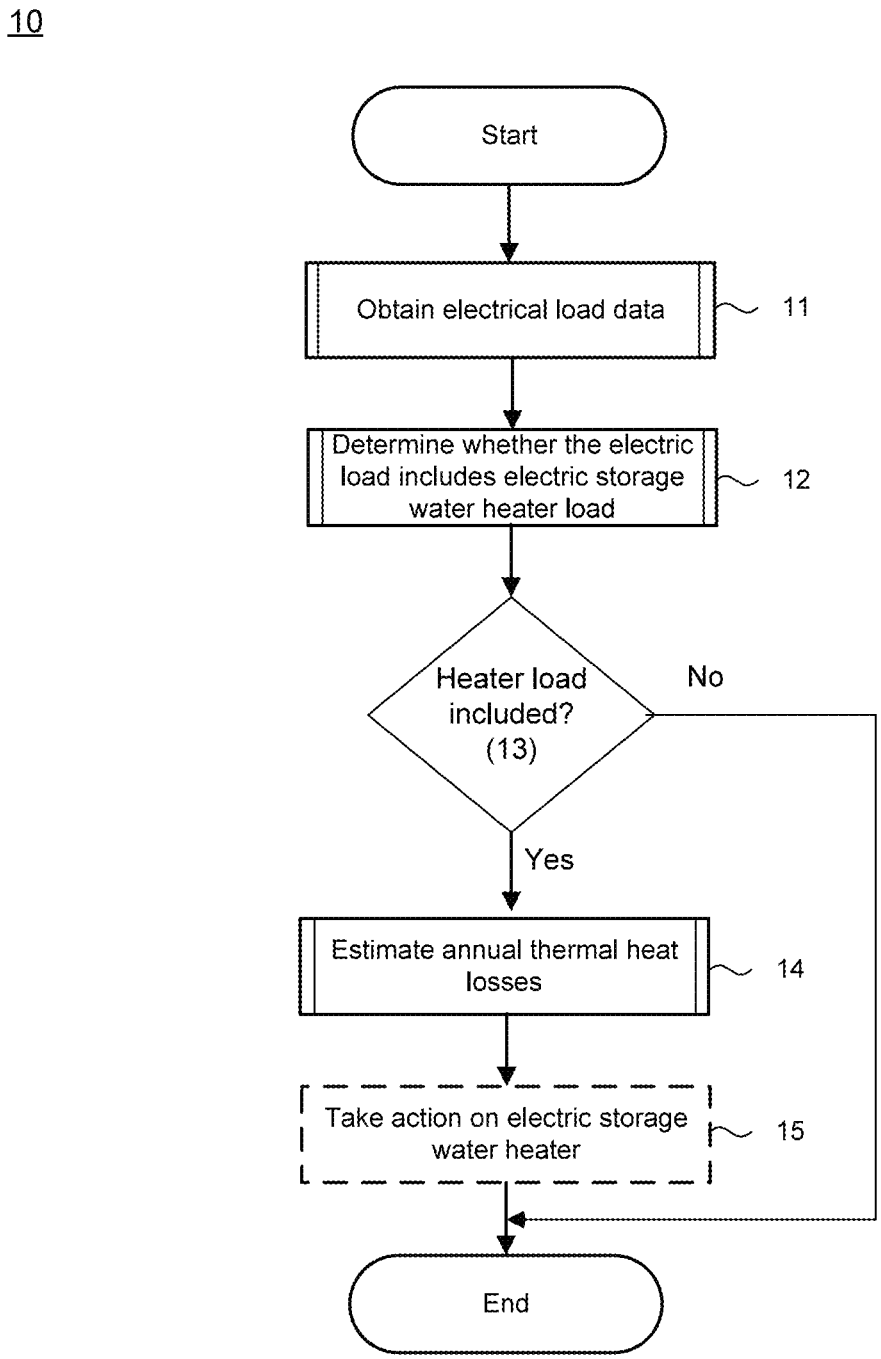
FIG. 1 is a flow diagram showing a method for electric storage water heater efficiency remote quantification in accordance with one embodiment.

The understanding of the factors that contribute to the overall energy consumption of the water heater allows for remote quantification of the presence and efficiency of an electric storage water heater in the building. FIG. 1 is a flow diagram showing a method 10 for electric storage water heater efficiency remote quantification in accordance with one embodiment. The method 10 can be executed using the system 230 described below with reference to FIG. 23. Initially, data regarding an electric load associated with a building is obtained for the relevant time period (step 11). While in the description below that time period is referred to as a year (and thus, the values related to that time period are annual), in a further embodiment, other lengths of the time period are possible. In one embodiment, the electric load can correspond to net load (electricity provided to the building from an external source over a set time period) and can be obtained using data from a utility company that supplies electric energy to the building or directly measured the electric energy supplied to the building from the electrical grid. In a further embodiment, if the building is connected to a renewable photovoltaic production system, the electric load can be determined by accounting for on-site photovoltaic production, as further described below with reference to FIG. 2. The electric load data is a time series, with each data point in the time series corresponding to the electric load during a particular time point. In one embodiment, the electric load data has an hourly resolution or greater (more detailed); if the resolution is less than hourly resolution, the electric load data is adjusted (such as through aggregating the data) to hourly resolution before proceeding to the next step (not shown).

Figure 3:
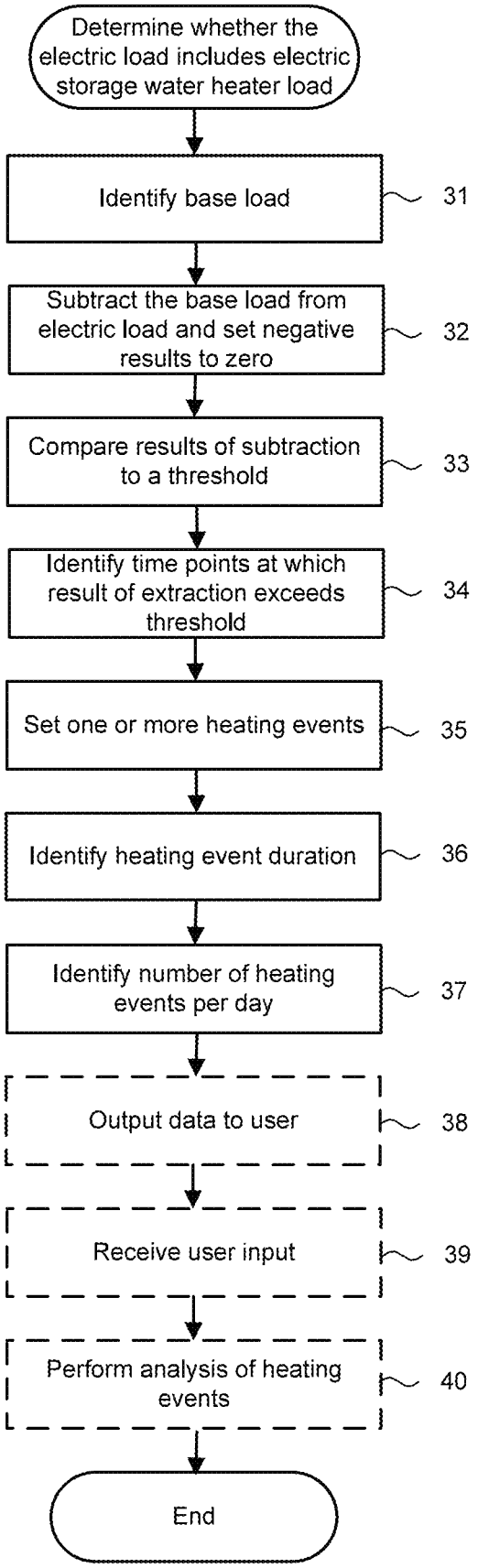
FIG. 3 is a flow diagram showing a routine for determining whether the electric load includes electric water heater load for the building for use in the method of FIG. 1.

A determination is obtained regarding whether the electric load determined in step 11 includes an electric load from the electric water heater storage, as further described beginning with reference to FIG. 3 (step 12). In a further embodiment, if the presence of a functioning electric storage water heater in the building is known prior to the beginning of the execution of the method 10 (and thus the load from the heater is known to be part of the electric load of the building), step 12 can be optional.

If the heater load is not included in the electric load determined in step 11 (step 13), that means that there is no functioning electric storage water heater in the building and the method 10 ends. If the heater load is included in the electric load determination (and thus a functioning electric storage water heater is present in the building) (step 13), annual thermal heat losses from the electric storage water heater are determined, as further described beginning with reference to FIG. 4 (step 14). The total annual thermal heat losses is a measure of the efficiency of the electric storage water heater, with a large annual heat thermal heat losses number signaling poor efficiency. Accordingly, upon quantifying the total annual heat losses, an action is optionally taken on the electric storage water heater (step 15), ending the method 10. The action can include adjusting the operation settings of the electric storage water heater, which can include stopping the operations of the electric storage water heater. If the method 10 is performed on a computer that is remote from the electric storage water heater, the adjustment can be performed remotely (such as by the computer interfacing with and sending commands to a controller of the electric storage water heater via the Internet, a cellular network, or another internetwork). Alternatively, if the method 10 is being performed by a controller of the electric storage water heater, the adjustment of the settings can be performed directly by the controller. In a further embodiment, when the efficiency is poor enough that a replacement of the electric storage water heater is warranted, the computer (either a remote computer or the controller of the electric storage water heater) can output the annual thermal losses (such as through a display of a device of a user) with a suggestion for a replacement, with the owner of the electric storage water heater making the replacement based on the suggestion.

Figure 2:
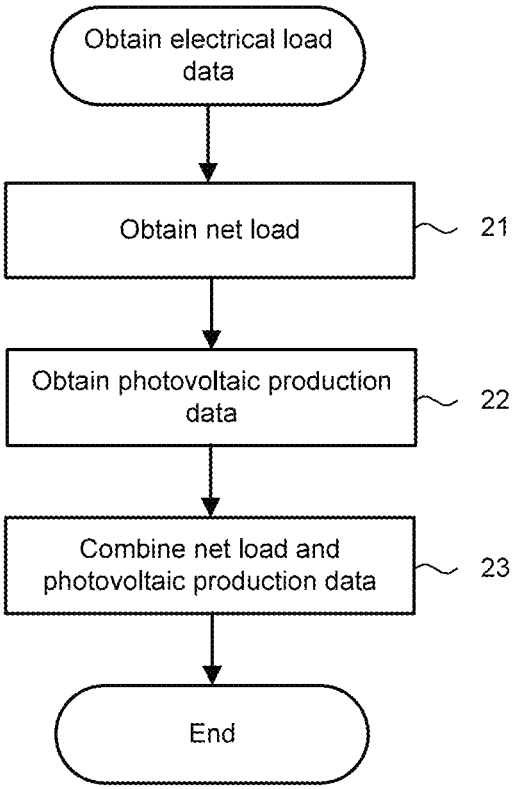
FIG. 2 is a flow diagram showing a routine for obtaining the electric load of the building for use in the method of FIG. 1 in accordance with one embodiment.

Presence of an on-site photovoltaic power generation system (or another renewable energy system) that provides power to the building can obscure the true electric load of the building. Accordingly, when such a photovoltaic system is present on-site at the building for which the method 10 is performed, the power provided by the on-site photovoltaic power generation system needs to be taken into account when determining the electric load. FIG. 2 is a flow diagram showing a routine 20 for obtaining the electric load of the building for use in the method 10 of FIG. 1 in accordance with one embodiment. Annual net load for the building is obtained (step 21), such as further described with reference to U.S. Pat. No. 10,719,636 ('636 patent), issued Jul. 21, 2020 to Thomas E. Hoff, the disclosure of which is incorporated by reference, though other ways to obtain the net load are possible. The net load data for the building can obtained by a power utility or energy agency, though other ways to obtain the net load are possible. Annual photovoltaic production data for the on-site photovoltaic system is obtained (step 22). In particular, the photovoltaic production data can be simulated for the building's location with the same time resolution as each point of net load data, as described in the '636 patent cited supra, though other ways to obtain the photovoltaic production data are possible. The photovoltaic production data simulation can also be performed as described in U.S. patent application Ser. No. 18/328,462, filed Jun. 2, 2023, entitled "System and Method For Inferring Photovoltaic System Specifications With The Aid of A Digital Computer" to Nakarmi et al., the disclosure of which is incorporated by reference. Still other ways to obtain the photovoltaic production data are possible. The net load and the photovoltaic production data are combined (added together) (step 23) to obtain annual gross load for the building, which is set as the annual electric load for the building, ending the routine 20.

Analysis of the electric load of the building allows to determine if there is a functioning water heater inside the building. FIG. 3 is a flow diagram showing a routine 30 for determining whether the electric load includes electric storage water heater load for the building for use in the method 10 of FIG. 1. Base load for the building is obtained during the same year as the year for which the electric load is obtained (step 31). Base load refers to a peak occurrence in a frequency distribution of net load data (and can also be defined as an average period demand for the electric power that most frequently occurs during a period of observation) and can be determined using the techniques described in U.S. Pat. No. 10,747,914, issued Aug. 18, 2020, to Thomas E. Hoff, the disclosure of which is incorporated by reference, though other ways to determine the base load are possible.

The base load is subtracted from the electric load data and any negative results are set to zero (step 32). As described above, the electric load data is a time series of data points, with each data point describing a value of the electric load at a particular time point. In step 32, the base load is subtracted from the electric load value at each of the time points, and thus multiple results of the subtraction are obtained (with any negative results being set to zero). The results of the subtraction are compared to a threshold (step 33) and the time points for which the result of the subtraction exceeds the threshold are identified (step 34). The identified time points are set as being associated with one or more heating events, with a set of time continuous time points being associated a single heating event (step 35), with a heating event being an event in which the electric storage water heater heats up water in the heater. A duration of each of the heating events is identified (step 36), with the duration being the time difference between an earliest time point associated with that heating event and a latest time point associated with that heating event. A number of heating events during each day of the relevant year are identified (step 37). Optionally, the number of the heating events per day and the duration of the heating events are output to a user (such as via a separate user computing device interfaced to the computer performing the method 10, or through a display directly connected to the computer performing the method 10). The user makes the decision regarding whether the electric load for the building includes the load for the electric storage water heater based on a visual inspection of the output data, with the events per day and event duration being key identifiers of whether the electric load for the building includes the load from the electric storage water heater. For example, a user skilled in the art can recognize the presence of an electric storage water heater by looking for multiple (2-5) short (<2 hours) events per day indicating a resistance electric storage water heater, or fewer (0.5-2) longer (2-4 hours) events per day indicating a HPWH. In one embodiment, when the events are evenly spaced in time from each other, the even spacing further points to the presence of the electric storage water heater in the building. The user provides input with the decision to the computer executing the method 10 (such as a via a user interface presented directly on the computer executing the method 10 or a user interface of the user's device that is interfaced to the computer executing the method 10), with the computer executing the method 10 receiving the input and setting the user's determination as the determination of whether the electric storage water heater for the building includes the load from the electric storage water heater. Alternatively, the determination regarding whether the electric load for the building includes the load from the electric storage water heater can be determined through analysis of the heating event duration and the number of events per day (step 40), ending the routine 30. For example, the computer could employ a machine-learning classifier to make the determination. The classifier is trained on a labeled data set which includes (but is not limited to) data for the heating events per day and heating event duration and whether the electric load connected with those heating events is part of the electric load for the building, and upon encountering the data from steps 36 and 37, the trained classifier makes the determination regarding whether the load associated with the heating events analyzed in steps 36 and 37 forms part of the electric load of the building. In a still further embodiment, both steps 39 and 40 could be performed, with a conflicting result being resolved by an input from the user.

Figure 4:
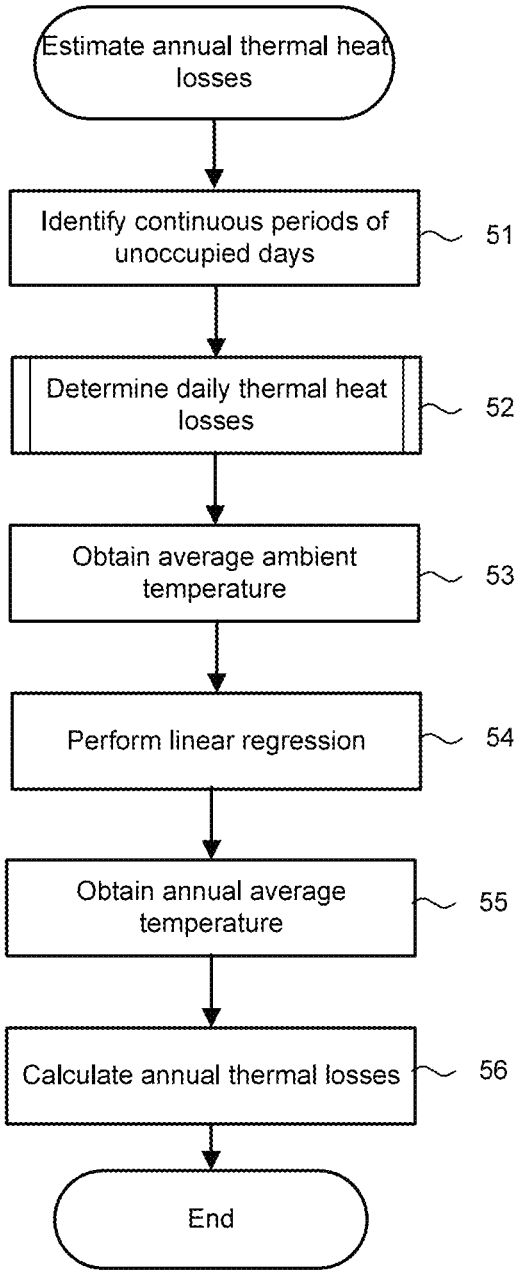
FIG. 4 is a flow diagram showing a routine for estimating annual thermal heat losses for use in the method of FIG. 1 in accordance with one embodiment.

Once the load associated with an electric storage water heater is determined to be part of the electric load for the building, annual thermal heat losses associated with the electric storage water heater can be determined. FIG. 4 is a flow diagram showing a routine 50 for estimating annual thermal heat losses for use in the method 10 of FIG. 1 in accordance with one embodiment. Continuous periods of days when the building is unoccupied are identified (step 51). An unoccupied day is a day in which a building has no occupants and can be identified as a day in which the daily electrical load is below a threshold ("Unoccupied Daily Load Threshold") and the daily standard deviation in the electric load is also below a threshold ("Unoccupied Standard Deviation Threshold."), though other ways to identify unoccupied days are possible. A continuous period of unoccupied days includes one or more such unoccupied days that directly follow each other without being interrupted by days in which the building is occupied.

Figure 5:
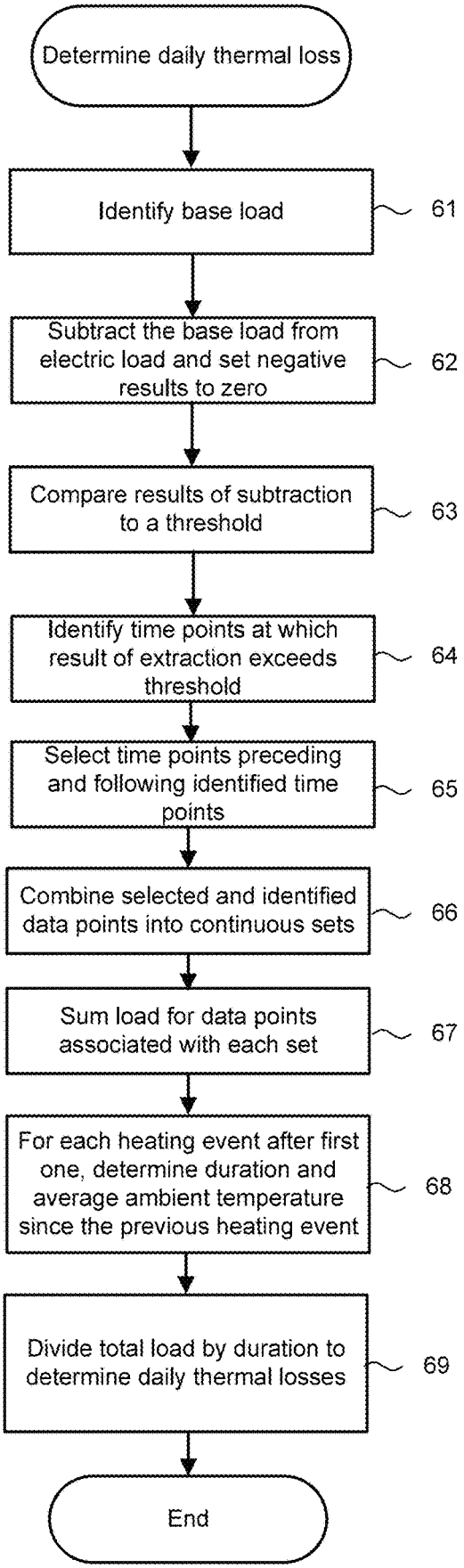
FIG. 5 is a flow diagram showing a routine for determining daily thermal losses of an electric storage water heater for use in the method of FIG. 1 in accordance with one embodiment.

Daily thermal losses for the electric storage water heater for heating events after the first one are determined, as further described below with reference to FIG. 5 (step 52). Values for average ambient temperatures associated with location (or proxy of location) of electric storage water heater between the heating events is obtained (step 52). The average ambient temperature can be obtained from publicly available sources (such as a weather website) or by interfacing with a sensor (via a wired or wireless connection) that is located by the electric storage water heater.

Linear regression on the daily thermal losses during the continuous periods obtained in step 52 versus the average ambient temperature obtained in step 53 is performed.

An annual average ambient temperature for the location (or proxy of location) of the electric storage water heater is obtained (step 55). Similarly to what is described above, the average temperature can be obtained from public sources or from a sensor positioned in the location of the electric storage water heater. Annual thermal heating losses of the electric storage water heater are calculated using the results of the linear regression and the annual average ambient temperature, as further described below (step 56), such as using the equations (1)-(3) given below, ending the routine 50.

Calculating the annual thermal losses involves first determining the daily thermal losses. FIG. 5 is a flow diagram showing a routine 60 for determining daily thermal losses of an electric storage water heater for use in the method of FIG. 1 in accordance with one embodiment. For each continuous period of unoccupied days, the base load for the building is obtained as described above (step 61). The base load is subtracted from the value of the electric load at each time point during each continuous period of unoccupied days and any negative results are set to zero (step 62). The results of the subtraction are compared to a threshold (step 63) and the time points at which the results of the subtraction exceed the threshold are identified (step 64). For each identified time point hour, a time point that immediately precedes and a time point immediately follows that identified time point are selected to capture partial operation events, (step 65). The identified time points and the selected adjacent time points are combined to form one or more continuous sets of non-zero data (step 66), with each continuous set including time points that directly follow each other and that are not interrupted by any time points that were not identified in step 64 or selected in step 65. Each continuous set of non-zero data is associated with one heating event and the electric load values at the time points included in each continuous set of non-zero data are summed together to obtain a load that is associated with the heating event associated with that continuous set of non-zero data (step 67). For each heating event after the first heating, a duration of that event is determined (the duration being the number of time points included in the continuous set of non-zero data associated with that heating event) and an average ambient temperature in the location of the electric storage water heater (or a proxy for the location) since the ending of the previous heating event (and before the beginning of the heating event under consideration) is obtained (step 68). The daily thermal losses for each of the heating events after the first heating event are determined by dividing the total load associated with that heating event by the duration of that heating event (step 69), ending the routine 60.

The method 10 described above was verified through empirical testing. Several examples of the application of the method 10 are described below. In the first example, the method 10 was performed using measured HPWH electric storage water heater data and ambient temperature data from the semi-conditioned area immediately surrounding the water heater (a garage). The goal of this example is to demonstrate method accuracy using directly measured data. The second example repeats the method 10 but replaces the garage temperature data with outdoor temperature data since few homes measure temperature in semi-conditioned areas while outdoor temperature is widely available. The final example repeats the method 10 using inferred water heating load from total load data since few homes measure water heater load.

Example 1: Method 10 Performed Using Measured HPWH Data and Garage Temperature Data In the first example, the electricity used for water heating and the ambient temperatures are both directly measured. In this example, the ambient temperature is taken in the garage where the water heater is located. The garage is not directly heated, but is well-insulated and shares walls with interior spaces of the home. Therefore, this space is considered as semi-conditioned.

Figure 6:
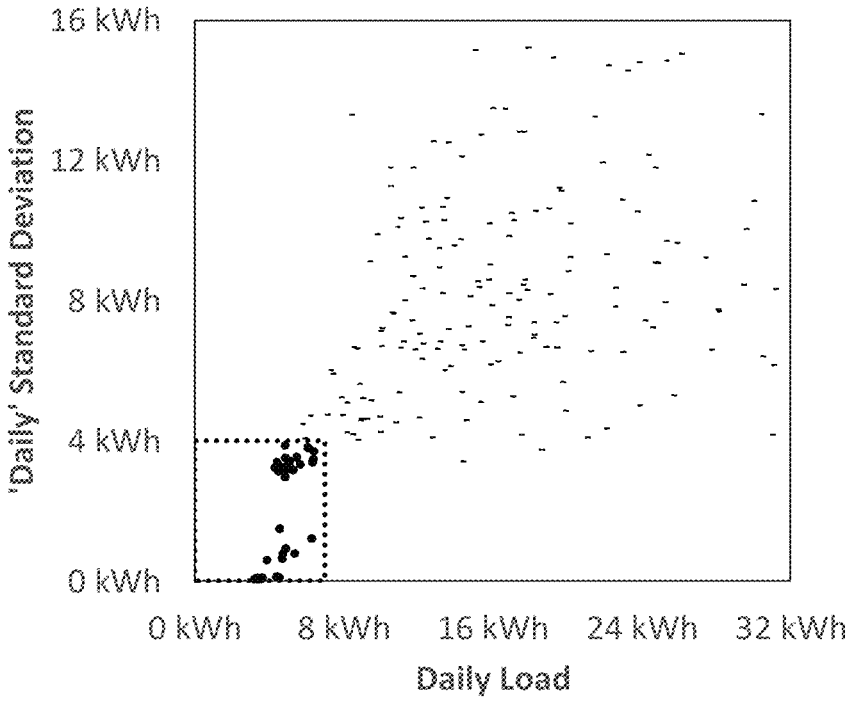
FIG. 6 is a diagram showing 'Daily' standard deviation of the change in electric load versus average daily electric load with unoccupied days highlighted by a dashed square.

FIG. 6 is a diagram 70 showing 'Daily' standard deviation of the change in electric load versus average daily electric load with unoccupied days highlighted by a dashed square. The diagram 70 plots the 'daily' standard deviation of the change in electric load versus average daily electric load for every day in the year. The daily standard deviation is calculated as the standard deviation of the change in hourly load for each day times 24 hours. The unoccupied days are indicated by larger markers surrounded by a dashed square. In this case, the Unoccupied Daily Load Threshold is selected to be 7.0 kWh and the Unoccupied Standard Deviation Threshold is selected to be 4.0 kWh. Other values are possible and there are other ways to identify days if the home was unoccupied. Results were verified by manually viewing the load to identify unoccupied days and those results were compared to the method 10 described above, with the manual review confirming that the method 10 correctly identified the unoccupied days.

Figure 7:
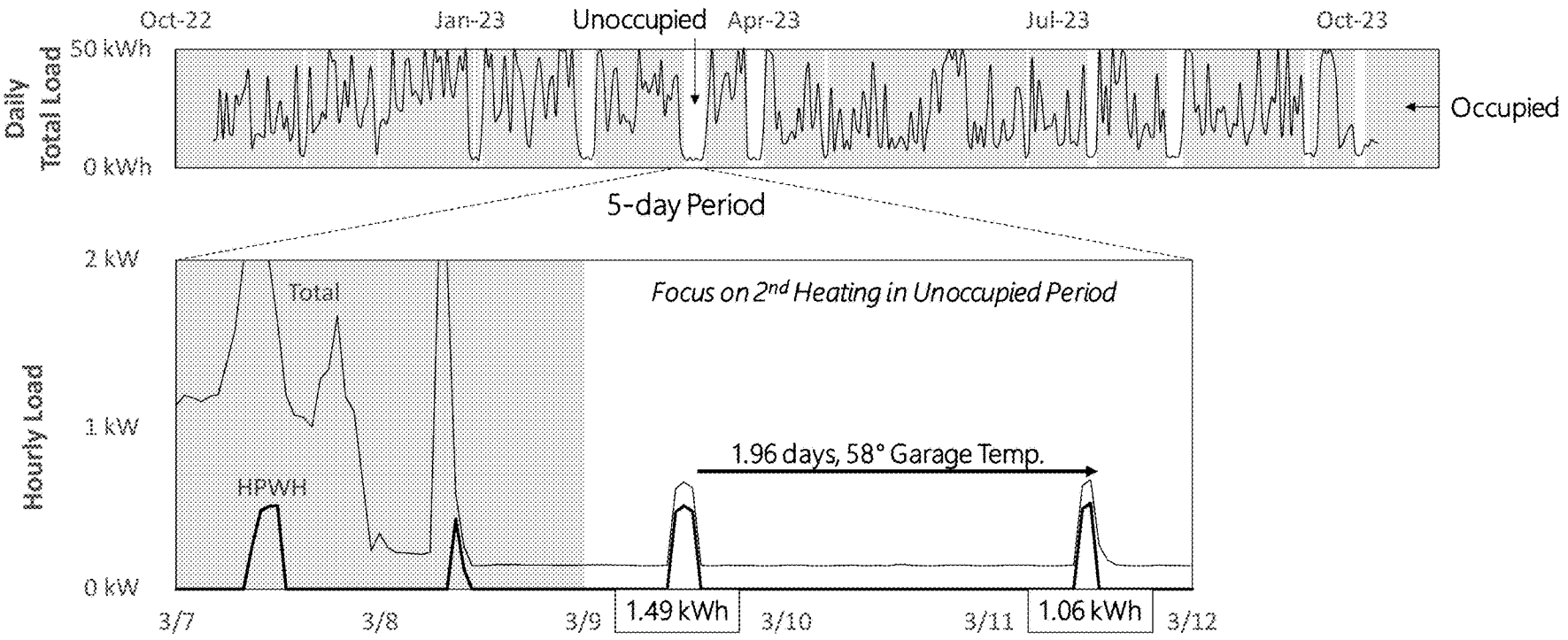
FIG. 7 is a diagram showing one year of daily electric load data screened to identify unoccupied days, with a focus on hourly loads for a five-day period, and a calculation of electricity consumed by HPWH on first and second heating events after home was unoccupied.

FIG. 7 is a diagram 80 showing one year of daily electric load data screened to identify unoccupied days, with a focus on hourly loads for a five-day period, and a calculation of electricity consumed by HPWH on first and second heating events after home was unoccupied. The top part of the diagram 80 presents one year of daily total electric load data screened to identify unoccupied days. The bottom part of the diagram 80 selects a five-day period out of the year and presents five days of hourly loads. The first two days represent when the home was identified as occupied and the last three days represent when the home was identified as unoccupied.

After identifying the unoccupied periods, the amount of energy consumed by the water heater for each contiguous event is calculated. A contiguous event is defined as having no zero HPWH load values between the non-zero HPWH loads. The diagram 80 also includes the duration since the first water heating event and the average garage temperature during the period since the first event. In this example, the HPWH consumed 1.49 kWh during the first event after the home was unoccupied. This event may include electricity used to replenish hot water consumed as well as thermal losses. The second event consumed 1.06 kWh over a period of 1.96 days. The ambient temperature (in the garage) averaged 58° during this time. No hot water was consumed in the unoccupied home. Thus, all the electricity was consumed to counteract thermal losses. The electricity consumed for thermal losses was 0.54 kWh per day (i.e., 1.06 kWh/1.96 days) for this event.

Figures 8, 9:
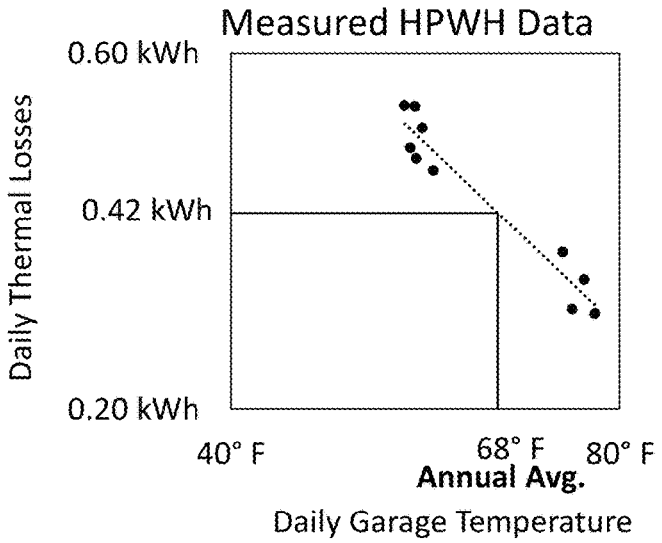
FIG. 8 is a diagram showing measured electricity consumption and associated average ambient (garage) temperatures during all unoccupied periods of the year and water heating events after the first event in each unoccupied period (i.e., results from FIG. 7 applied to all periods and events).
FIG. 9 is a diagram 100 showing linear regression of energy consumed by the water heater to counteract daily thermal losses versus average ambient (garage) temperature (i.e., data from FIG. 8).

The diagram 80 of FIG. 7 shows that there were many periods when the home was identified as being unoccupied. FIG. 8 is a diagram 90 showing measured electricity consumption and associated average ambient (garage) temperatures during all unoccupied periods of the year and water heating events after the first event in each unoccupied period (i.e., results from FIG. 7 applied to all periods and events). There is no direct hot water consumption after the first event in each unoccupied period. Thus, this consumption corresponds to the amount of electricity required to compensate for thermal losses. Note that some of the unoccupied periods had only one water heating event while others had multiple water heating events. Multiple events occur when the home was unoccupied for enough time for the water heater to operate multiple times to replenish the heat lost from thermal losses.

FIG. 9 is a diagram 100 showing linear regression of energy consumed by the water heater to counteract daily thermal losses versus average ambient (garage) temperature (i.e., data from FIG. 8). The diagram 100 also includes linear regression results. The linear regression of daily energy consumption for thermal losses is of the form:

$$\text{Daily Consumption} = m * \text{Avg. Daily Ambient Temperature} + b \quad (1)$$

where Avg. Daily Ambient Temperature is the average temperature of the air around the HPWH over the course of a day.

Annual Energy Consumption for thermal losses equals the sum of the Daily Consumption over the year.

$$\text{Annual Consumption} = \sum_{days} \text{Daily Consumption}_{day} \quad (2)$$

Substitute Equation (1) into Equation (2), and simplify.

$$\text{Annual Consumption} = 365 * (m * \text{Avg. Annual Ambient Temperature} + b) \quad (3)$$

Equation (3) shows that daily losses corresponding to the time when the ambient temperature was at the average value for the year, multiplied by 365 gives the Annual Consumption necessary to counteract thermal losses.

The annual energy consumed for thermal losses equals 153 kWh per year (i.e., 0.42 kWh/day*365 days per year) in this case.

Example 2: Method 10 Performed Using Measured HPWH Data and Outdoor Temperature Data One limitation of the previous analysis in Example 1 is that few homes record time series ambient temperature data at the water heater location. For water heaters located inside the home, one can use the indoor temperature. Many water heaters, however, are in a garage, basement, or outside of the home. In this case, another temperature data source is required.

Figure 10:
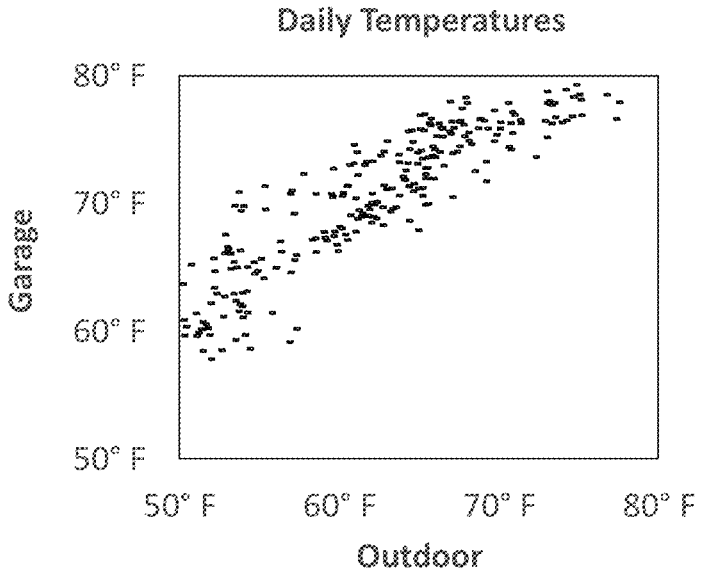
FIG. 10 is a diagram showing average daily garage temperature versus average daily outdoor temperature.

FIG. 10 is a diagram 110 showing average daily garage temperature versus average daily outdoor temperature. The diagram 110 shows that as the outdoor temperature increases, the garage temperature also increases. Therefore, the two temperatures are correlated.

Since a correlation exists, outdoor temperature can be used in place (as a proxy) of garage temperature.

Figure 11:
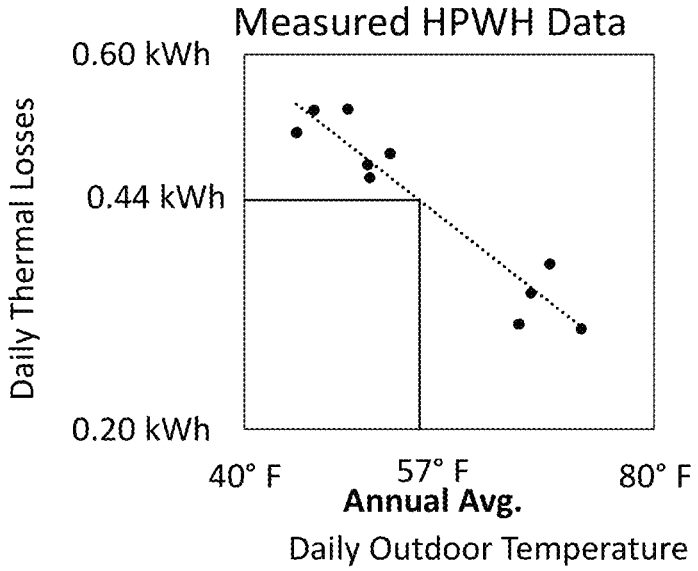
FIG. 11 is a diagram 120 showing linear regression of electricity consumed by the water heater to counteract daily thermal losses versus outdoor temperature.

FIG. 11 is a diagram 120 showing linear regression of electricity consumed by the water heater to counteract daily thermal losses versus outdoor temperature. FIG. 11 repeats the analysis presented in FIG. 9 using outdoor temperature in place of garage temperature. From this analysis, the energy consumed for daily thermal losses on the average day equals 0.44 kWh per day. This compares well to the 0.42 kWh per day obtained using garage temperature, providing initial validation of an approach to use outdoor temperature as a proxy for the ambient temperature when the water heater is in the garage or other semi-conditioned space.

Example 3: Method 10 Performed Using Inferred HPWH Data

Another limitation of the previous analysis of Example 1 is that few homes record the time series water heater electricity consumption data. This Example 3 describes how to infer that data and then to use that data in the analysis.

Briefly, as described above, first, hourly time series net load data for the home is obtained. Next, if the home has photovoltaic production, simulate photovoltaic production data for the building's location with the same time resolution as each point of net load data, as described in the '636 patent cited supra (though other ways to obtain the photovoltaic production data are possible). The photovoltaic production data simulation can also be performed as described in U.S. patent application Ser. No. 18/328,462, filed Jun. 2, 2023, entitled "System and Method For Inferring Photovoltaic System Specifications With The Aid of A Digital Computer" to Nakarmi et al., the disclosure of which is incorporated by reference. Still other ways to obtain the photovoltaic production data are possible. Gross (total) load is reconstructed from the net load data and simulated PV production data.

Next, identify unoccupied days as described above. In this case, however, all of the data is of interest, not just the data that corresponds to the first water heating event. This change is because the first water heating event is unknown since the water heating consumption data is not yet available.

Figure 12:
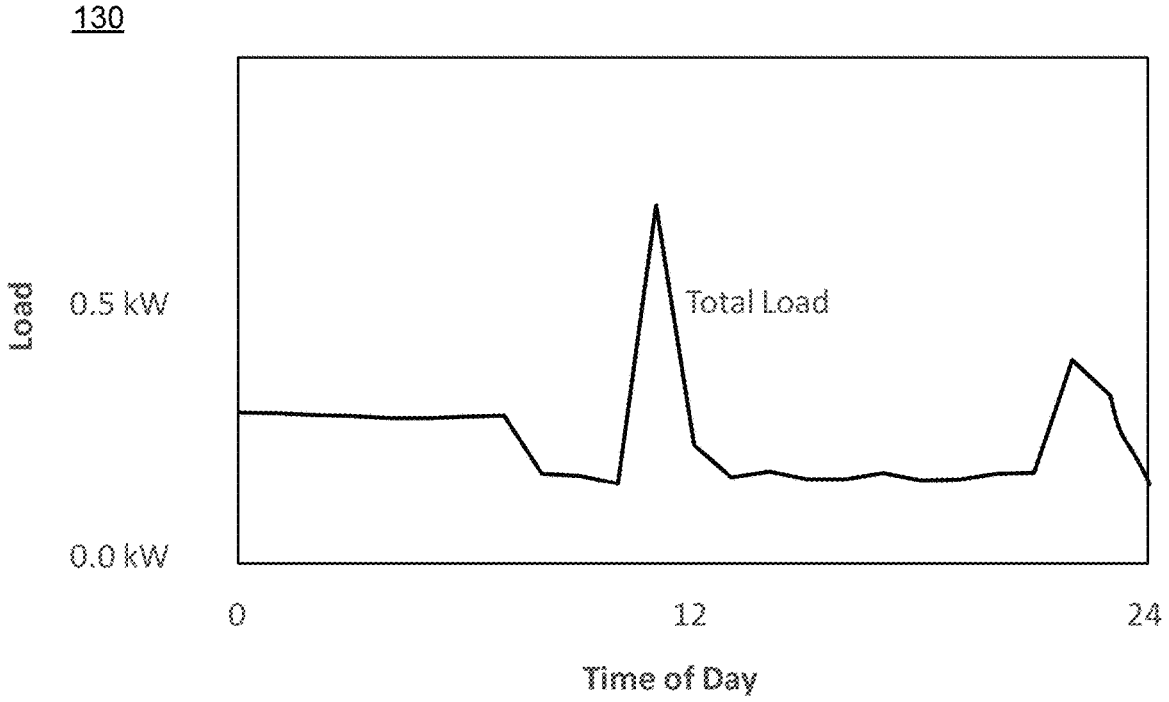
FIG. 12 is a diagram 130 showing the hourly total load on a sample unoccupied day.

FIG. 12 is a diagram 130 showing the hourly total load on a sample unoccupied day. Baseload consumption is estimated (such as using the techniques described in U.S. Pat. No. 10,747,914, issued Aug. 18, 2020, to Thomas E. Hoff, the disclosure of which is incorporated by reference, though other ways to determine the base load are possible) to calculate the baseload during the unoccupied period of which the unoccupied day is a part.

Figure 13:
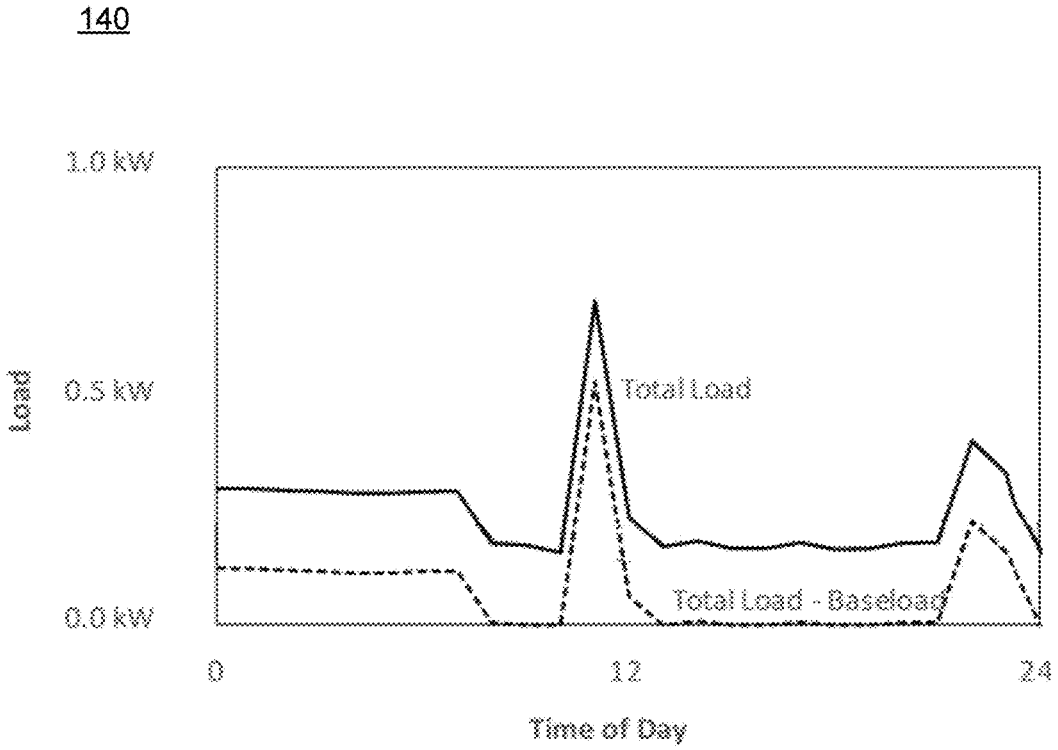
FIG. 13 is diagram showing total electric load, baseload, and total load minus baseload on a sample, unoccupied day.

As described above, baseload is subtracted from the total load and any resulting negative values to 0, as illustrated by FIG. 13. FIG. 13 is diagram 140 showing total electric load, baseload, and total load minus baseload on a sample, unoccupied day.

For homes where the presence of an electric storage water heater is unknown, a determination of whether the total load includes water heating needs to be performed. As described above, this determination can be done by inspecting the total load during unoccupied days and identifying the presence or absence of water heating loads. Water heater loads can be identified via visual inspection of the load or by a machine learning algorithm that has been trained on a labeled set of data.

Once the presence of an electric storage water heater has been confirmed, a Threshold Water Heater Load is set. In this case, 0.3 kW is selected, though other values are also possible.

Figure 14:
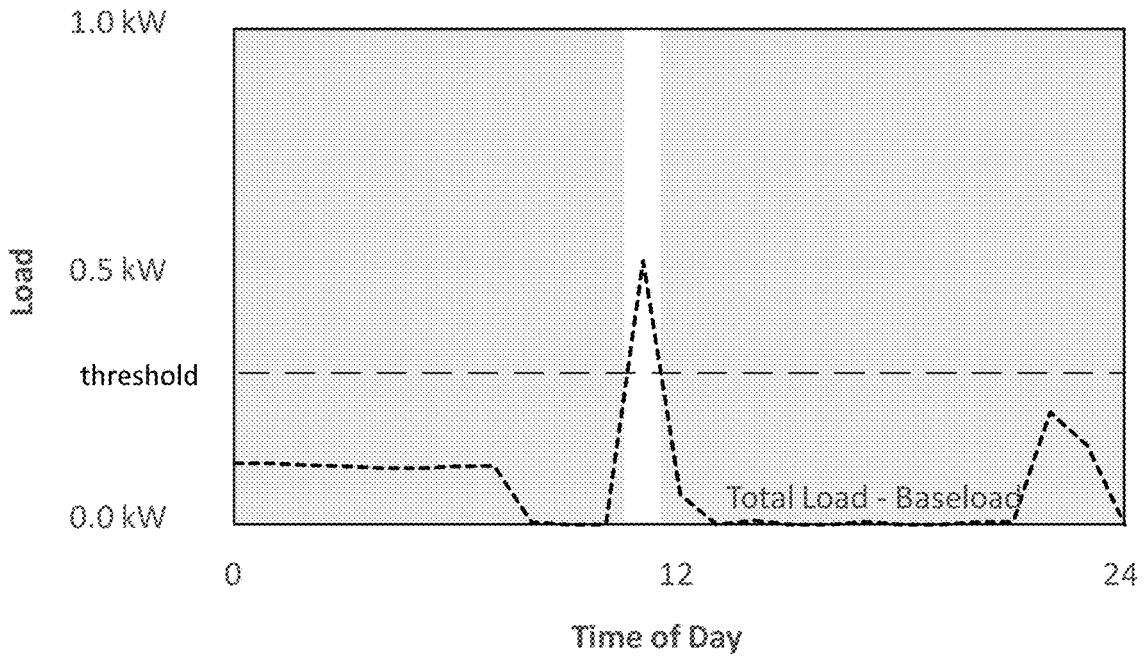
FIG. 14 is a diagram showing inclusion of hours where total electric load minus baseload is greater than Threshold Water Heater Load on a sample, unoccupied day.
Figure 15:
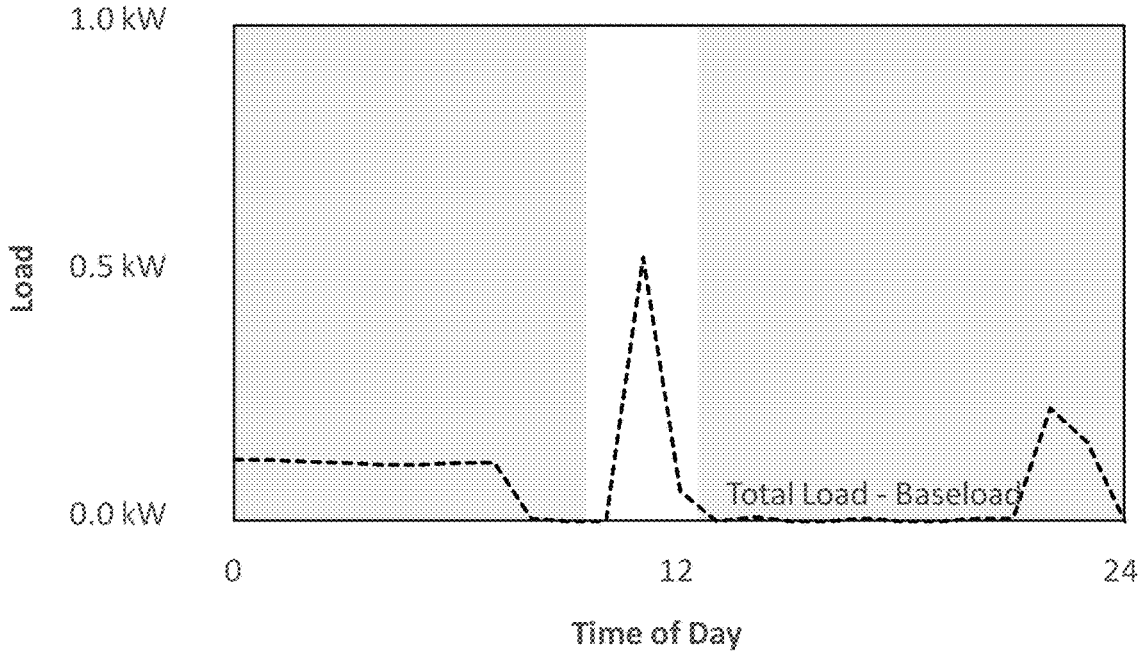
FIG. 15 is a diagram showing an expansion of inclusion window in FIG. 14 to include partial water heater operation one hour before and one hour after water heater hourly load operation on a sample, unoccupied day.

FIG. 14 is a diagram 150 showing inclusion of hours where total electric load minus baseload is greater than Threshold Water Heater Load on a sample, unoccupied day. FIG. 15 is a diagram 160 showing an expansion of inclusion window in FIG. 14 to include partial water heater operation one hour before and one hour after water heater hourly load operation on a sample, unoccupied day. This window expansion occurs because the water heating load can start mid-hour. The partial hour loads are small but need to be included to account for the complete period of water heater operation.

Figure 16:
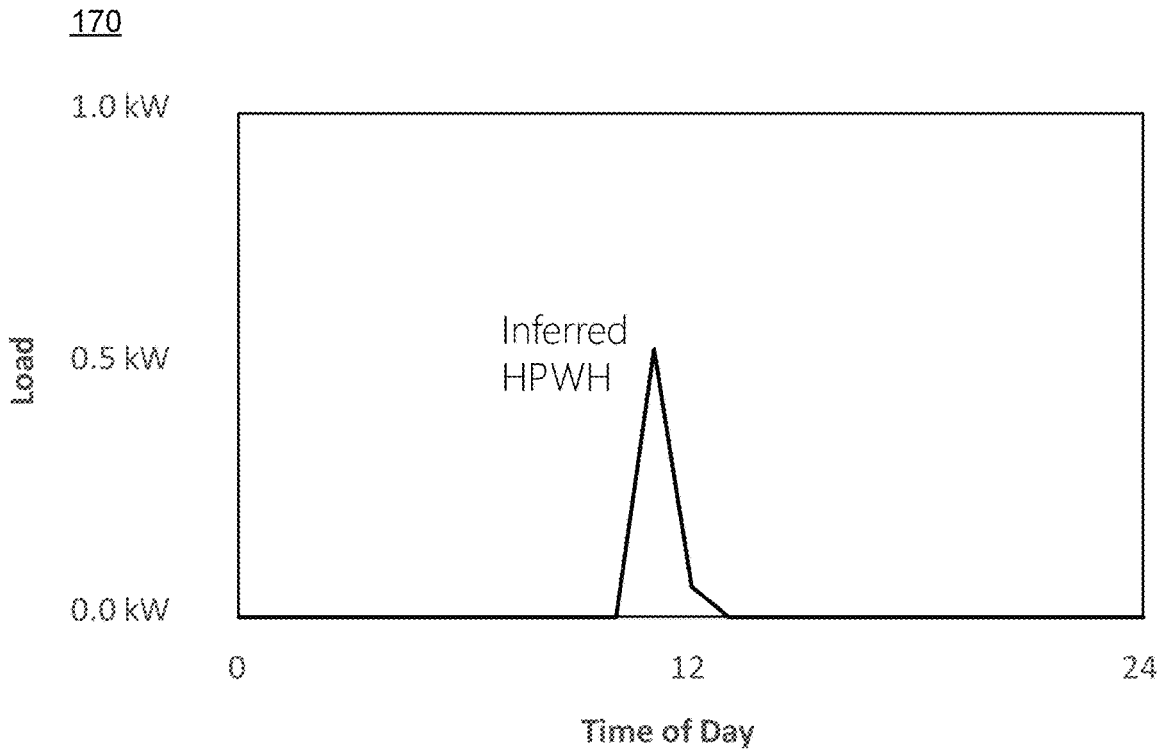
FIG. 16 is a diagram showing Inferred HPWH load on a sample, unoccupied day.
Figure 17:
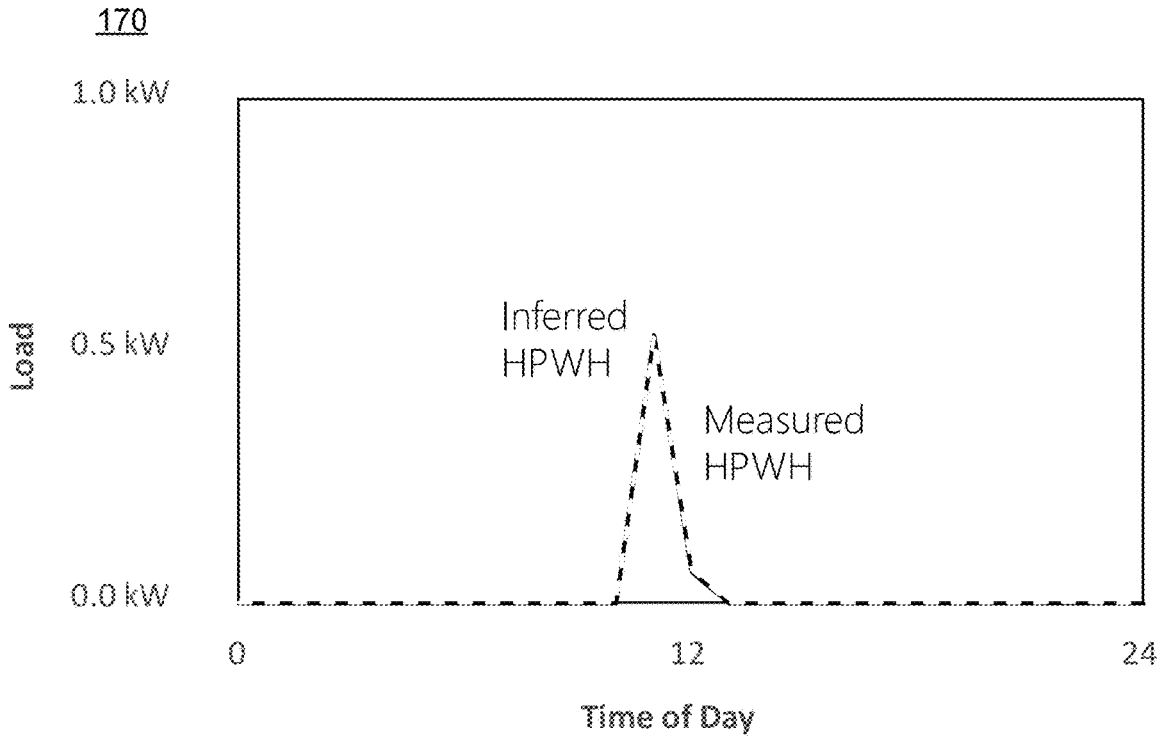
FIG. 17 is a diagram showing a comparison of Inferred HPWH load to measured HPWH load on a sample, unoccupied day and indicates that the inferred HPWH load matches the measured HPWH load for this unoccupied day.

The remaining load equals the Inferred HPWH load as presented in FIG. 16, which is a diagram 170 showing Inferred HPWH load on a sample, unoccupied day. FIG. 17 is a diagram 180 showing a comparison of Inferred HPWH load to measured HPWH load on a sample, unoccupied day and indicates that the inferred HPWH load matches the measured HPWH load for this unoccupied day.

Figure 18:
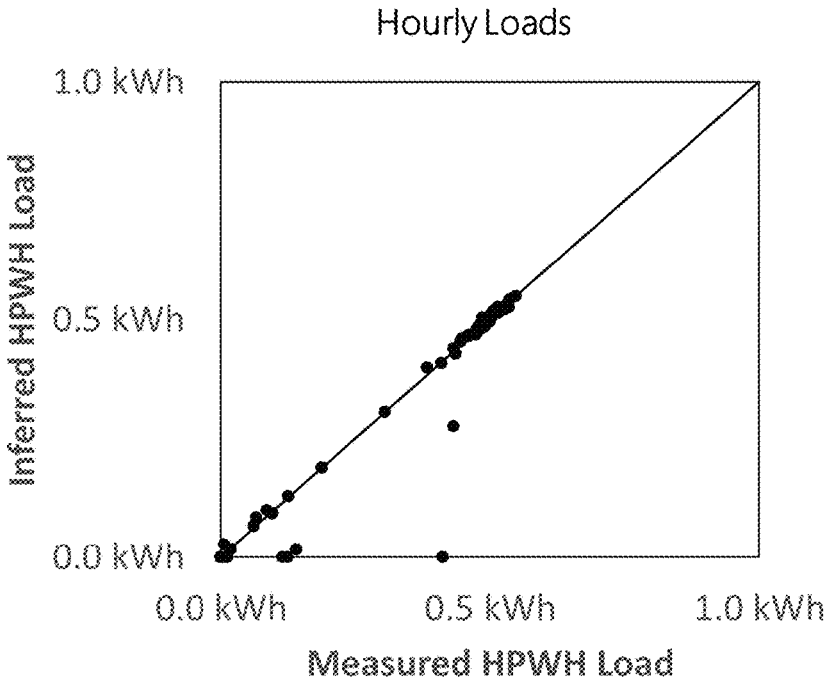
FIG. 18 is a diagram showing a comparison of hourly inferred HPWH load to measured HPWH load for each hour of non-zero measured HPWH load during all unoccupied days.

FIG. 18 is a diagram 190 showing a comparison of hourly inferred HPWH load to measured HPWH load for each hour of non-zero measured HPWH load during all unoccupied days. Results show that the inferred and measured load values are strongly correlated. In this case, there is a 6 percent relative mean absolute error on hourly basis, suggesting that the results are reliable.

Figure 19:
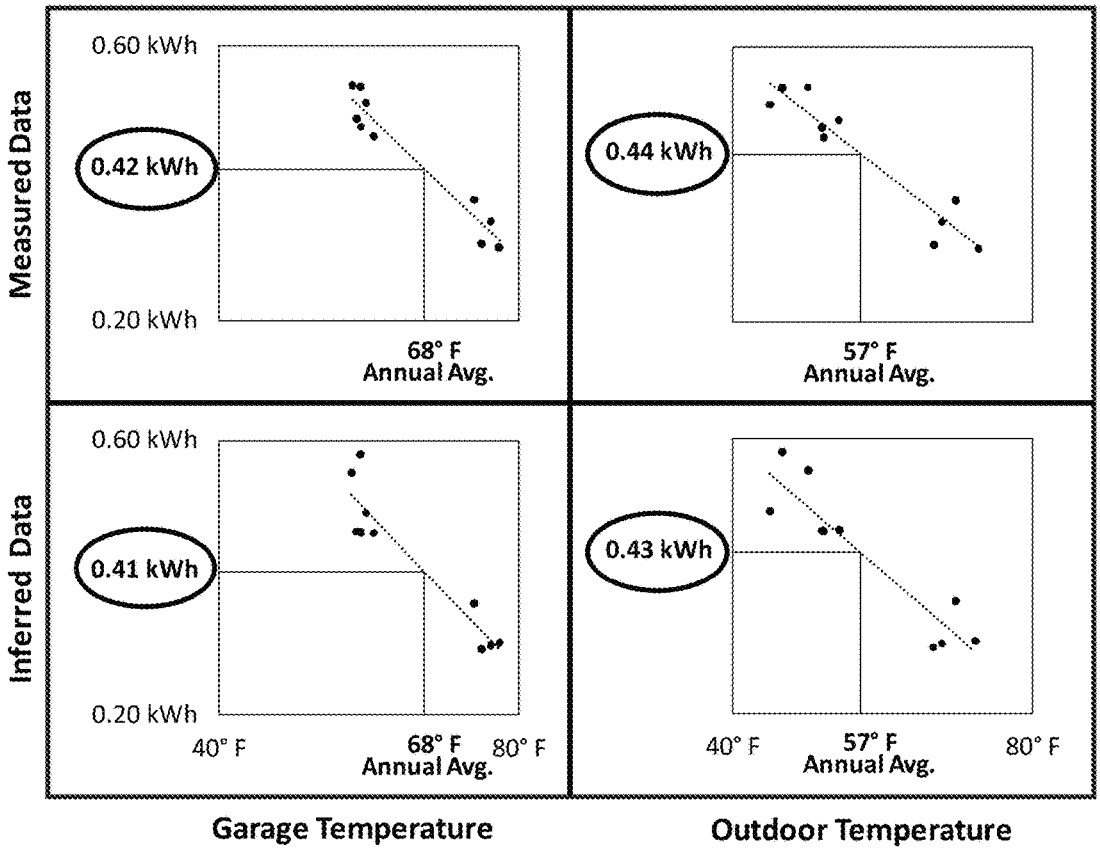
FIG. 19 is a diagram showing linear regression of energy consumed to counteract daily thermal losses using four data combinations.
Figure 20:
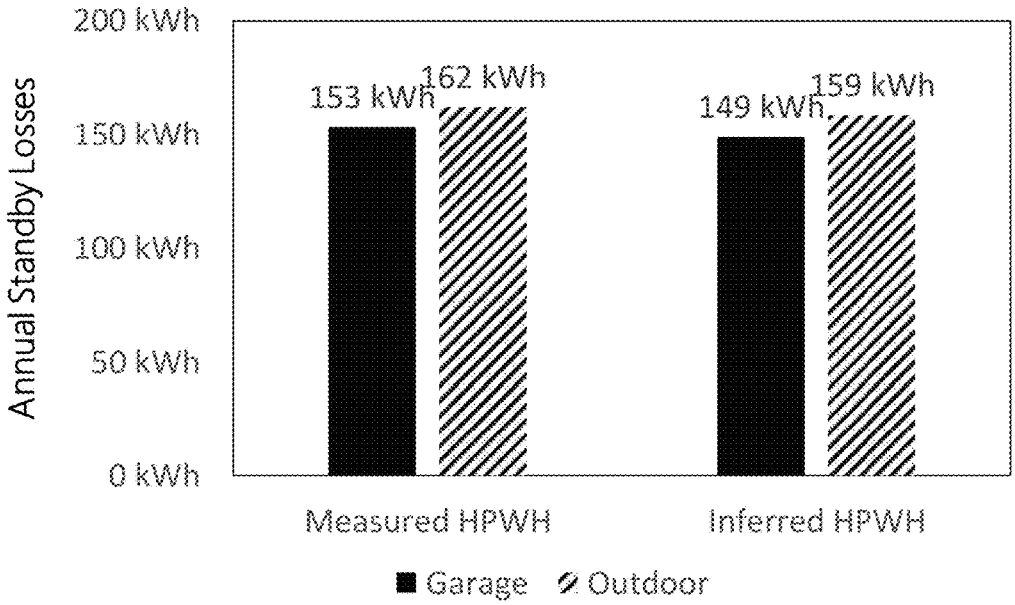
FIG. 20 is a diagram showing annual thermal losses for four data combinations.

The Measured HPWH load can now be replaced with the Inferred HPWH load and the analyses according to the method 10 described above repeated. FIGS. 19-20 present the results. FIG. 19 is a diagram 200 showing linear regression of energy consumed to counteract daily thermal losses using four data combinations. FIG. 20 is a diagram 210 showing annual thermal losses for four data combinations. FIG. 20 shows that the annual thermal losses are similar using all data source combinations (measured versus inferred HPWH load and garage versus outdoor temperature).

Applications Towards Home Energy Recommendations and Management

Figure 21:
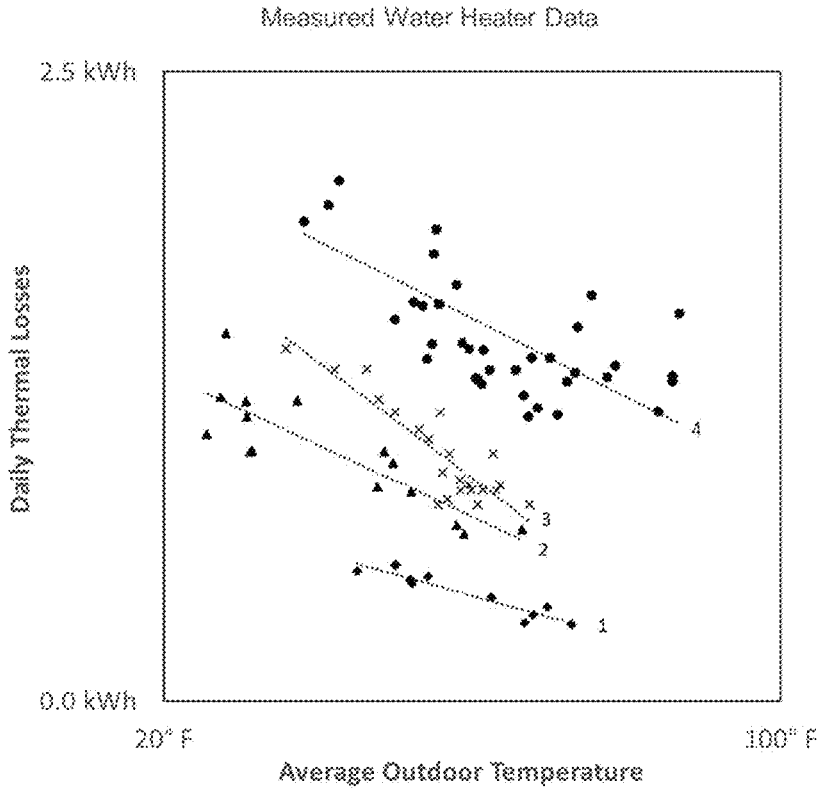
FIG. 21 presents a graph showing linear regression of electricity consumed by four water heaters counteract daily thermal losses versus outdoor temperature.

The output of the method 10 and system 230 (described below) is a valuable tool for managing efficiency and energy consumption of an electric storage water heater. The above analysis described with regards to Examples 1-3 has been performed on four US homes with varied locations and water heater types. FIG. 21 presents a graph 220 showing linear regression of electricity consumed by four water heaters to counteract daily thermal losses versus outdoor temperature. The measured water heater data are from each of the four homes under study and are numbered 1-4, with the numbering of the homes being the same as in the table of 221 of FIG. 22. FIG. 22 is table 221 showing calculated average daily thermal losses (standby energy) and standby cost for the four individual water heaters of the four houses under study, including basic home and water heater information, as well as the results of the audit for each home.

FIG. 21 shows that the standby losses of storage water heaters can vary widely. The differences come not only from the type and efficiency of the water heater in question, but also from the placement and settings. The home in Napa, CA (Home 1) has the highest efficiency water heater with the lowest impact of outdoor temperature. This result is not surprising because the water heater in the home is a heat pump water heater with good insulation installed in a semi-conditioned location. From an energy auditing perspective, this would be a good result and unlikely to be indicated as a reported area that could be improved by different equipment or settings.

Comparison of Homes 2, 3, and 4 in FIGS. 21 and 22 is of particular interest because these water heaters are of the same type with similar size and Uniform Energy Factors. With the same placement and usage these water heaters would be expected to have similar thermal losses. For homes 2 and 3, the major difference is in the location of the water heaters. Home 2's water heater is located within the conditioned envelope of the home and is not subjected to extreme temperatures. Home 3's placement in an exterior closet results in a steeper slope in the model. As the outdoor temperature drops, the water heater loses heat at a faster rate than the water heater in Home 2.

Home 4 has a slope similar to Home 2 in the graph 220 of FIG. 21, however, the overall standby losses are much higher, resulting in an increased cost of operation. Although the exact reasons for increased usage are unknown using this remote method, the water heaters may be operated at different temperatures. A higher setpoint temperature could explain the higher losses experienced by the water heater in Home 4.

These results can be used to communicate possible improvements to each homeowner. Homes 2, 3, and 4 could all possibly switch to heat pump water heaters to improve efficiency, and Home 4 could review their water heater's settings to determine if the operating temperature could be lowered. Alternatively, the electric storage water heater can be controlled automatically, either by a computerized controller that is proximate or a part of the electric storage water heater or by a remote computer controlling the electric storage water heater over an internetwork such as the Internet or a cellular network. For example, if analysis of the electric load reveals that the house is unoccupied at the point of time the analysis is taking place or that the house has been unoccupied for a threshold number of days (indicating that the occupants are on vacation), the electric storage water heater can be automatically switched to standby mode through computerized control. Likewise, if the annual thermal heating losses for an electric storage water heater exceed a particular threshold, the electric storage water heater could be automatically switched to operate (and heat water) at a lower temperature to bring the thermal losses below the threshold. Other ways to control the electric storage water heater through computerized control are possible. For example, the ambient temperature around the electric storage water heater can be monitored and based on the temperature, the owner could be automatically (such as through a computer device of the owner) notified regarding ways to optimize energy consumption. Alternatively, or in addition, the computer performing the monitoring can automatically implement such recommendations, such as by adjust the operating temperature of the electric storage water heater based on the monitored temperature to make sure that the heater operations remains within predefined parameters (such as maintaining the consumption of electricity by the heater within a certain cost limit). Such monitoring could be conducted through a sensor that is interfaced (through a wired or a wireless connection) to the computer performing the monitoring. The sensor can be a part of the electric storage water heater or be a standalone sensor.

The System

Figure 23:
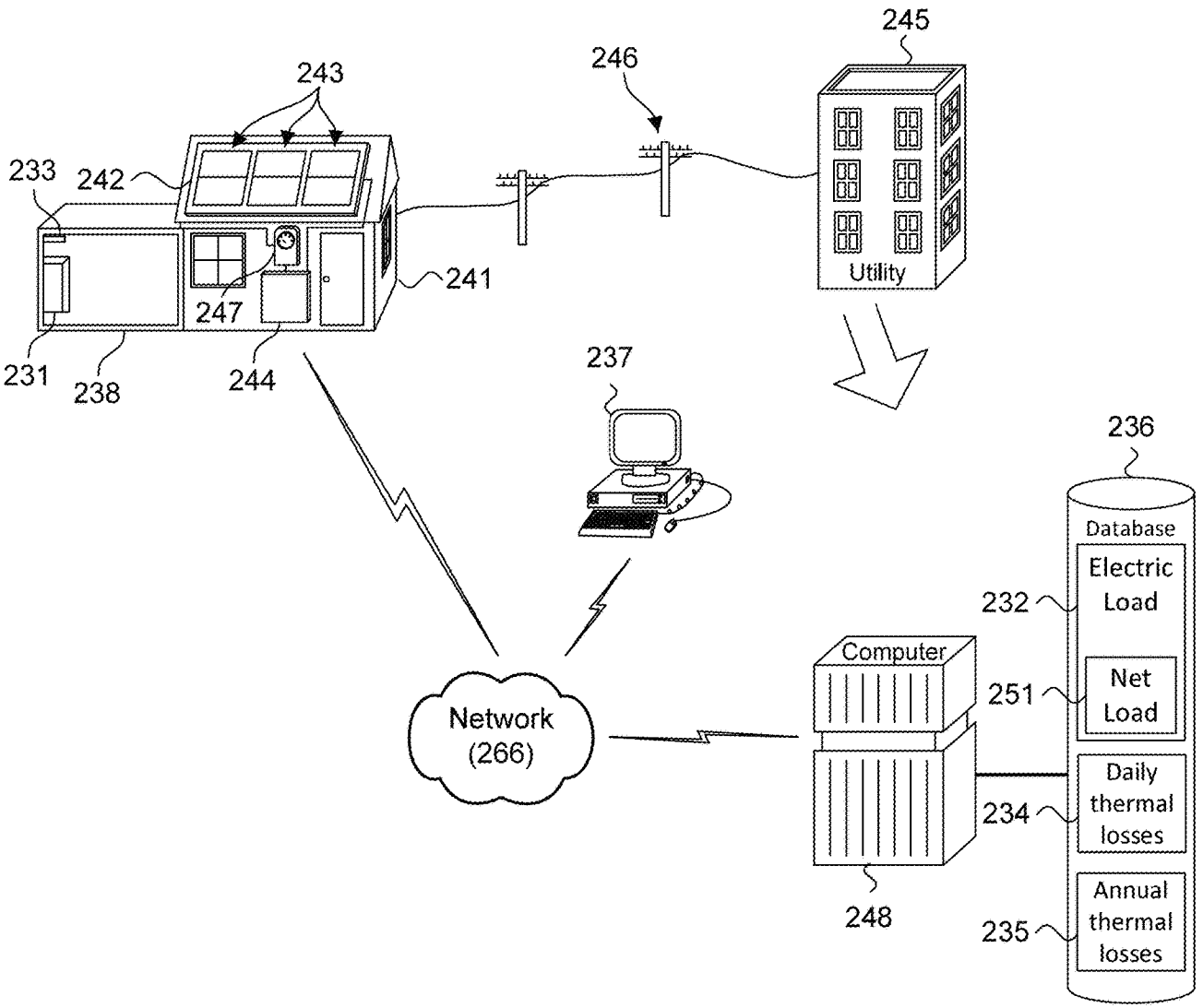
FIG. 23 is a block diagram showing a system for electric storage water heater efficiency remote quantification with the aid of a digital computer in accordance with one embodiment.

The quantification of an electric storage water heater's efficiency can be done remotely using the techniques described above and below, thus allowing to avoid an intrusive and costly physical audit of the premises on which the water heater is located. FIG. 23 is a block diagram showing a system 230 for electric storage water heater 231 efficiency remote quantification with the aid of a digital computer 248 in accordance with one embodiment. The computer 248 includes hardware components conventionally found in a general-purpose programmable computing device, such as a central processing unit, memory, user interfacing means, such as a keyboard, mouse, and display, input/output ports, network interface, and non-volatile storage, and execute software programs structured into routines, functions, and modules for execution on the various systems. In addition, other configurations of computational resources, whether provided as a dedicated standalone computer system or arranged in client-server or peer-to-peer topologies, and including unitary or distributed processing (including in a cloud computing environment), communications, storage, and user interfacing, are possible. In addition, the computer can be remote from the water heater 231 and interface with the water heater 231 via a network (266), such as the Internet or a cellular network. Alternatively, at least a part of the computer 248 can be proximate to, or even a part of the water heater 231.

The computer 248 executes the methodology described infra beginning with reference to FIG. 1 and as further detailed herein to quantify the efficiency of the electric storage water heater 231. In one embodiment, in addition to being able to quantify the efficiency of the water heater 231, the computer 248 can further control the operations of the water heater 231. The water heater 231 can be an HPWH, though other types of storage water heaters 231 that use electric power are possible. As part of the execution of the methodology, the computer 248 can interact with a power utility 245 as well as other third party information sources (such as weather websites) to obtain the necessary electric load data 232 (net load data 251 in particular) and temperature information. For example, a power utility 245 provides electricity over a distribution grid 246 to individual consumers 241 (such as the building in which the water heater 231 is positioned), including residential, commercial, private, public, governmental, and other consumers. A NEM meter 247 is installed at each consumer 241 that has a PV system 242 installed. Each PV system 242 includes an array of PV panels 243 or modules coupled to an inverter 244 that converts direct current to alternating current. Other components working as a part of or in tandem with the PV system 242, such as batteries (not shown) to store electricity from the solar panels, are possible.

The computer 248 can store received and obtained data, including the electric load 232, the net load 251, the daily 234 and annual thermal losses 235 as well as other information in a storage 236 interfaced in to the computer 248. While the storage 236 is shown as external with reference to FIG. 22, the storage could also be an integral part of the computer 248.

The computer 248 can further interface, via wired connections, wireless connections, or both with a sensor 233 located either on or in proximity with the water heater 231, or in a location that is a proxy for the location of the water heater, such as outside of the garage 238 in which the water heater is located.

In addition, the computer 248 can output results of the method 10 to a user, including via a display forming a part of the computer, or through a user device 237, such as a mobile phone, laptop computer, desktop computer, tablet, or another computing device of the user.

While the invention has been particularly shown and described as referenced to the embodiments thereof, those skilled in the art will understand that the foregoing and other changes in form and detail may be made therein without departing from the spirit and scope of the invention.

The invention claimed is:

1. A system for electric storage water heater efficiency remote quantification with an aid of a digital computer, comprising:

a computer comprising a processor and memory within which code for execution by the processor is stored, the computer configured to:

obtain electric load data regarding an electric load associated with a building during a time period;

identify unoccupied days during the time period during which the building was unoccupied;

obtain a determination of whether the electric load for the building comprises an electric storage water heater load associated with the building using the identified unoccupied days;

upon determining that the electric load comprises the electric storage water heater load, estimate thermal heat losses that are during the time period and that are associated with the electric storage water heater load, comprising:

identify one or more continuous periods of the unoccupied days during the time period;

determine daily thermal losses associated with the electric storage water heater during portions of one or more of the continuous periods;

obtain an average ambient temperature associated with a location of the electric storage water heater during the portions;

perform linear regression on the daily thermal losses versus the average ambient temperature;

obtain an average ambient temperature that is associated with the electric storage water heater during the time period;

calculate the thermal heat losses associated with the electric storage water heater during the time period using a result of the linear regression and the average ambient temperature during the time period; and perform an at least one change to the electric storage water heater based on the thermal heat losses during the time period by adjusting an operation of the electric storage water heater.

2. A system according to claim 1, the computer further configured to:

obtain net load data for the building that is representative of electricity provided to the building from an external source over the time period;

obtain photovoltaic production data for the building that is representative of electricity generated on-site over the time period; and combine the net load data and the photovoltaic production data into gross load data that is representative of overall electricity consumed over the time period; and set the gross load data as the electric load data during the time period.

3. A system according to claim 2, the computer further configured to set the electric load data to hourly resolution.

4. A system according to claim 1, wherein the electric load data comprises a plurality of data points, wherein each of the data points comprises the data regarding the electric load during one of a plurality of time points during the time period, the computer further configured to:

identify a base load for the building during the time period;

subtract the base load from the electric load at each of the time points that occurred during one of the unoccupied days to obtain results of the subtraction and set the results of the subtraction that are negative to equal zero;

compare the results of the subtraction to a threshold;

identify the time points associated with the results of the subtraction exceeding the threshold; and set one or more heating events, each of the heating events occurring during one or more of the identified time points, wherein the determination that the electric load for the building includes the load associated with the electric storage water heater is made based on the set heating events.

5. A system according to claim 4, the computer further configured to:

determine a duration of each of the heating events;

for each day during the time period during which at least one of the heating events occurs, determine a number of the heating events that occur during that day;

display to a user the numbers of the heating events and the durations of the heating events; and receive input from the user comprising the determination that the electric load for the building includes the load associated with the electric storage water heater.

6. A system in according to claim 4, the computer further configured to:

determine a duration of each of the heating events;

for each day during the time period during which at least one of the heating events occurs, determine a number of the heating events that occur during that day; and analyze the numbers of the heating events and the durations of the heating events, wherein the determination that the electric load for the building comprises 8 the load associated with the electric storage water heater is made based on the analysis.

7. A system in according to claim 6, wherein the analysis is performed by a trained artificial intelligence classifier.

8. A system in according to claim 1, wherein the electric load data comprises a plurality of data points, wherein each of the data points comprises the data regarding the electric load during one of a plurality of time points during the time period, the computer further configured to:

identify a base load for the building during each of the continuous periods;

subtract the base load from the electric load at each of the time points during each of the continuous periods to obtain results of the subtraction and set the results of the subtraction that are negative to equal zero;

compare the results of the subtraction to a threshold;

identify the time points associated with the results of the subtraction exceeding the threshold;

for each of the identified time points, select the time point that immediately precedes that identified data point and the time point that immediately follows that identified time point;

combine identified and selected time points that are continuous with each other into one or more continuous sets of non-zero data, wherein each of the sets is associated with one of a plurality of heating events;

for each of the continuous sets of non-zero data, sum the load associated with all of the time points in the set to determine a total load associated with the heating event associated with that continuous set; and for each heating event that happened after a first one of the heating events, calculate a time that passed since a previous one of the heating events and the average ambient temperature since the previous heating event and divide the total load associated with that heating event by the average ambient temperature since the previous heating event to determine the daily thermal loss associated with that heating event.

9. A system in according to claim 1, wherein the average ambient temperature is for one of a location of the electric storage water heater and a proxy for the location of the electric storage water heater.

10. A method for electric storage water heater efficiency remote quantification with an aid of a digital computer, comprising steps of:

obtaining, by a computer, data regarding an electric load associated with a building during a time period;

identifying, by the computer, unoccupied days during the time period during which the building was unoccupied;

obtaining, by the computer, a determination of whether the electric load for the building comprises an electric storage water heater load associated with the building using the identified unoccupied days;

upon determining that the electric load comprises the electric storage water heater load, estimating, by the computer, thermal heat losses that are during the time period that are associated with the electric storage water heater load, comprising:

identifying one or more continuous periods of the unoccupied days during the time period;

determining daily thermal losses associated with the electric storage water heater during portions of one or more of the continuous periods;

obtaining an average ambient temperature associated with a location of the electric storage water heater during the portions;

performing linear regression on the daily thermal losses versus the average ambient temperature;

obtaining an average ambient temperature that is associated with the electric storage water heater during the time period;

calculating the thermal heat losses associated with the electric storage water heater during the time period using a result of the linear regression and the average ambient temperature during the time period; and performing, by the computer, an at least one change to the electric storage water heater based on the thermal heat losses during the time period by adjusting an operation of the electric storage water heater.

11. A method according to claim 10, further comprising:

obtaining, by the computer, net load data for the building that is representative of electricity provided to the building from an external source over the time period;

obtaining, by the computer, photovoltaic production data for the building that is representative of electricity generated on-site over the time period; and combining by the computer the net load data and the photovoltaic production data into gross load data that is representative of overall electricity consumed over the time period; and setting the gross load data as the electric load data during the time period.

12. A method according to claim 11, further comprising setting the electric load data to hourly resolution.

13. A method according to claim 10, wherein the electric load data comprises a plurality of data points, wherein each of the data points comprises the data regarding the electric load during one of a plurality of time points during the time period, further comprising:

identifying by the computer a base load for the building during the time period;

subtracting by the computer the base load from the electric load at each of the time points that occurred during one of the unoccupied days to obtain results of the subtraction and setting by the computer the results of the subtraction that are negative to equal zero;

comparing by the computer the results of the subtraction to a threshold;

identifying by the computer the time points associated with the results of the subtraction exceeding the threshold; and setting by the computer one or more heating events, each of the heating events occurring during one or more of the identified time points, wherein the determination that the electric load for the building includes the load associated with the electric storage water heater is made based on the set heating events.

14. A method according to claim 13, further comprising:

determining by the computer a duration of each of the heating events;

for each day during the time period during which at least one of the heating events occurs, determining by the computer a number of the heating events that occur during that day;

displaying by the computer to a user the numbers of the heating events and the durations of the heating events; and receiving by the computer input from the user comprising the determination that the electric load for the building includes the load associated with the electric storage water heater.

15. A method according to claim 13, further comprising:

determining by the computer a duration of each of the heating events;

for each day during the time period during which at least one of the heating events occurs, determining a number of the heating events that occur during that day; and analyzing the numbers of the heating events and the durations of the heating events, wherein the determination that the electric load for the building comprises the load associated with the electric storage water heater is made based on the analysis.

16. A method according to claim 15, wherein the analysis is performed by a trained artificial intelligence classifier.

17. A method according to claim 10, wherein the electric load data comprises a plurality of data points, wherein each of the data points comprises the data regarding the electric load during one of a plurality of time points during the time period, further comprising:

identifying by the computer a base load for the building during each of the continuous periods;

subtracting by the computer the base load from each the electric load at each of the time points during each of the continuous periods to obtain results of the subtraction and setting by the computer the results of the subtraction that are negative to equal zero;

comparing by the computer the results of the subtraction to a threshold;

identifying by the computer the time points associated with the results of the subtraction exceeding the threshold;

for each of the identified time points, selecting by the computer the time point that immediately precedes that identified time point and the time point that immediately follows that identified time point;

combining by the computer the identified and selected time points that are continuous with each other into one or more continuous sets of non-zero data, wherein each of the sets is associated with one of a plurality of heating events;

for each of the continuous sets of non-zero data, summing by the computer the load associated with all of the time points in the set to determine a total load associated with the heating event associated with that continuous set; and for each of the heating events that happened after a first one of the heating events, calculate a time that passed since a previous one of the heating events and the average ambient temperature since the previous heating event and divide the total load associated with that heating event by the average ambient temperature since the previous heating event to determine the daily thermal loss associated with that heating event.

18. A method according to claim 10, wherein the average ambient temperature is for one of a location of the electric storage water heater and a proxy for the location of the electric storage water heater.

* * * * *